US005155007A

United States Patent [19]

Hara et al.

[11] Patent Number: 5,155,007

[45] Date of Patent: Oct. 13, 1992

[54] SILVER HALIDE PHOTOGRAPHIC MATERIAL

[75] Inventors: Yoji Hara; Akira Kobayashi; Takeshi Sampei; Miho Sai; Akira Ogasawara, all of Hino, Japan

[73] Assignee: Konica Corporation, Tokyo, Japan

[21] Appl. No.: 675,636

[22] Filed: Mar. 22, 1991

[30] Foreign Application Priority Data

Mar. 30, 1990 [JP] Japan ..... 2-83338

[51] Int. Cl.[5] ..... G03C 1/34; G03C 1/42

[52] U.S. Cl. ..... 430/264; 430/598; 430/607; 430/610; 430/613; 430/614

[58] Field of Search ..... 430/264, 607, 610, 614, 430/613, 598, 634, 635

[56] References Cited

U.S. PATENT DOCUMENTS

| | | | |
|---|---|---|---|
| 3,545,974 | 12/1970 | Nishio et al. | 430/635 |
| 4,269,929 | 5/1981 | Nothnagle | 430/264 |
| 4,755,449 | 7/1988 | Inoue et al. | 430/264 |
| 4,977,063 | 12/1990 | Osagawa | 430/264 |
| 4,988,603 | 1/1991 | Takamuki et al. | 430/264 |
| 5,102,779 | 4/1992 | Kojima et al. | 430/264 |

*Primary Examiner*—Richard L. Schilling
*Attorney, Agent, or Firm*—Frishauf, Holtz, Goodman & Woodward

[57] ABSTRACT

An improved silver halide photographic material that has at least one silver halide emulsion layer on a support and that contains a hydrazine derivative in said emulsion layer or an adjacent layer. The improvement is that said emulsion layer or at least one of the other hydrophilic colloidal layers contains at least one of the compounds represented by the following general formulas (I) and (II):

(I)

(II)

wherein $R_1$ and $R_1'$ are each a group selected from among a substituted or unsubstituted alkane residue, an alkene residue, a benzene residue, a cyclohexane residue and a nitrogenous heterocyclic residue; $R_2$ is a substituted or unsubstituted alkyl group; $R_3$, $R_3'$, $R_4$ and $R_4'$ are each a hydrogen atom or a substituted or unsubstituted methyl group, provided that $R_3$ and $R_4$ or $R_3'$ are not a methyl group at the same time; Y is a divalent organic residue; M and M' are each a hydrogen atom, an alkali metal, an ammonium salt or an organic amine salt; P is a positive integer; and m is 0 to 1.

10 Claims, No Drawings

SILVER HALIDE PHOTOGRAPHIC MATERIAL

BACKGROUND OF THE INVENTION

This invention relates to a silver halide photographic material more particularly to one having high contrast.

Photographic image of high contrast is used to form characters and halftone dots in photochemical processes, as well as fineline image in superfine photochemical processes. Certain types of silver halide photographic materials that are used for these purposes are known to be capable of forming photographic image having very high contrast. In the prior art, light-sensitive materials using a silver chlorobromide emulsion that comprises uniformly shaped grains with an average grain size of 0.2 μm and a narrow size distribution and that has a high silver chloride content (of at least 50 mol %) are treated with alkaline hydroquinone developing solutions with low sulfite ion concentrations to produce an image of high contrast, sharpness and resolution, such as a halftone image or fineline image. Silver halide light-sensitive materials used in this method are known as photosensitive materials of the lith type.

The photochemical process includes the step of converting a continuous tone image to a halftone image, namely, the step of converting the change of density in a continuous tone image to a set of halftone dots having areas proportional to the image density. To this end, a document of continuous tone is imaged on the lith-type photosensitive material through a cross-line screen or a contact screen and the material is subsequently developed to form a halftone image. The lith-type photosensitive material used in this step is a silver halide photographic material that contains a silver halide emulsion comprising uniformly sized and shaped fine grains. If this type of photographic material is developed with a common black-and-white developing solution, the resulting dot quality is inferior to that achieved by treatment with a lithographic developing solution which has a very low sulfite ion concentration and which contains hydroquinone as the sole developing agent. However, a lithographic developing solution is so susceptible to autoxidation that its keeping quality is very low. Since controlling the quality of development to be constant is very important for continuous use of developers, much effort is being made to improve the keeping quality of lithographic developing solutions.

With a view to maintaining the keeping quality of lithographic developing solutions, a so-called "two-liquid separated compensation" method is commonly adopted in automatic processors for photochemical processes. This method uses two different replenishers, one being used to compensate for process fatigue (i.e., the deterioration of activity due to development) and the other being used to compensate for aging fatigue (i.e., the deterioration by oxidation due to aging). A problem with this method is that the need to control the balance between the two replenishers for proper replenishment increases the complexity of the apparatus and operations. Further, lithographic development is not capable of rapid access since its induction period (the time required for image to become visible upon development) is long.

Methods are known that are capable of rapid formation of high-contrast image without using lithographic developing solutions. As described in U.S. Pat. No. 2,419,975 and Unexamined Published Japanese Patent Application Nos. 16623/1976 and 20921/1976, etc., these methods are characterized by incorporating hydrazine derivatives in silver halide light-sensitive materials, which hence can be processed with developing solutions that contain sulfite ions at sufficiently enhanced concentrations to insure higher keeping quality. However, the photographic materials processed with these methods have low sensitivity and the halftone image obtained has "black peppers" or sand-like fog in dots and hence is low in quality. In an attempt at solving this problem, various stabilizers or restrainers having hetero atoms have been added but this has not proved to be a complete solution.

SUMMARY OF THE INVENTION

The present invention has been achieved under these circumstances and has as an object providing an image forming method which is capable of producing contrasty image in a rapid and consistent way.

A second object of the present invention is to provide a contrasty silver halide photographic material that is free from the fog problems including "black peppers".

These and other objects of the present invention will become apparent by reading the following description.

The above-stated objects of the present invention can be attained by a silver halide photographic material that has at least one silver halide emulsion layer on a support and which contains a hydrazine derivative in said emulsion layer or an adjacent layer, which photographic material is characterized in that said emulsion layer or at least one of the other hydrophilic colloidal layers contains at least one of the compounds represented by the following general formulas (I) and (11):

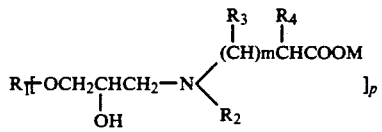

(I)

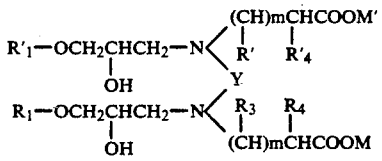

(II)

where $R_1$ and $R_1'$ are each a group selected from among a substituted or unsubstituted alkane residue, an alkene residue, a benzene residue, a cyclohexane residue and a nitrogenous heterocyclic residue; $R_2$ is a substituted or unsubstituted alkyl group; $R_3$, $R_3'$, $R_4$ and $R_4'$ are each a hydrogen atom or a substituted or unsubstituted methyl group, provided that $R_3$ and $R_4$ or $R_3'$ and $R_4'$ are not a methyl group at the same time; Y is a divalent organic residue; M and M' are each a hydrogen atom, an alkali metal, an ammonium salt or an organic amine salt; P is a positive integer; and m is 0 or 1.

DETAILED DESCRIPTION OF THE INVENTION

Specific examples of the compounds represented by the general formulas (I) and (II) are listed below but it should be understood that these are not the sole examples of the compounds that can be used in the present invention.

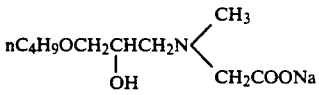
I-1
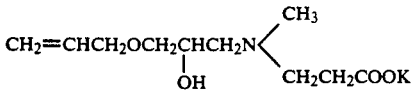
I-2
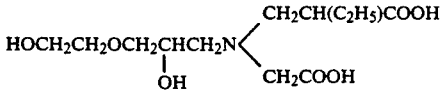
I-3
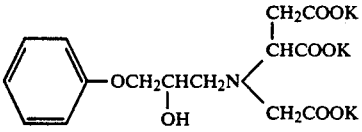
I-4
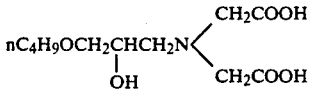
I-5
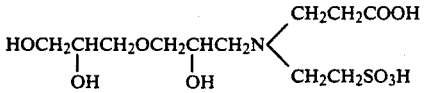
I-6
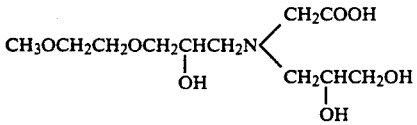
I-7
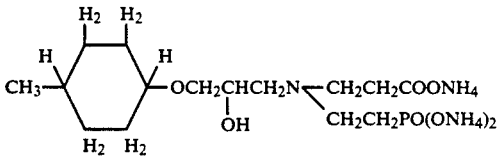
I-8
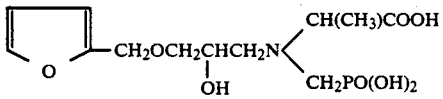
I-9
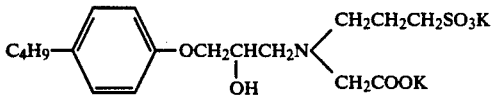
I-10
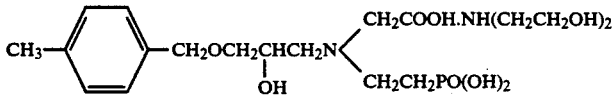
I-11
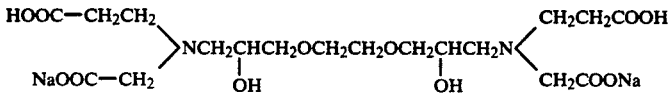
I-12
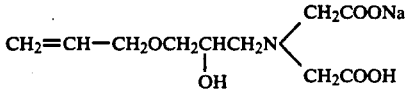
I-13

-continued

I-14

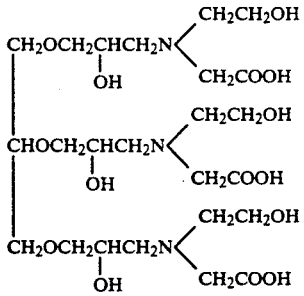

I-15

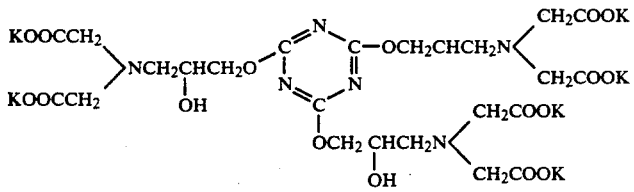

I-16

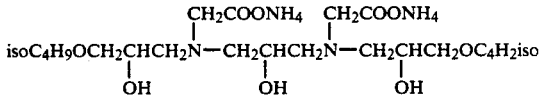

I-17

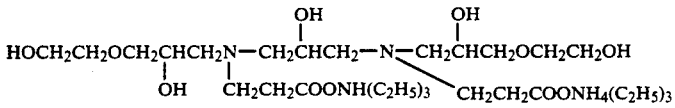

I-18

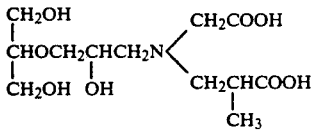

I-19

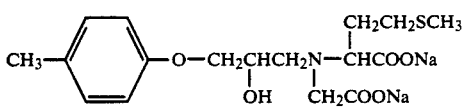

I-20

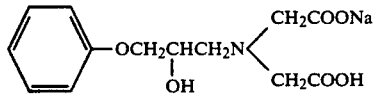

I-21

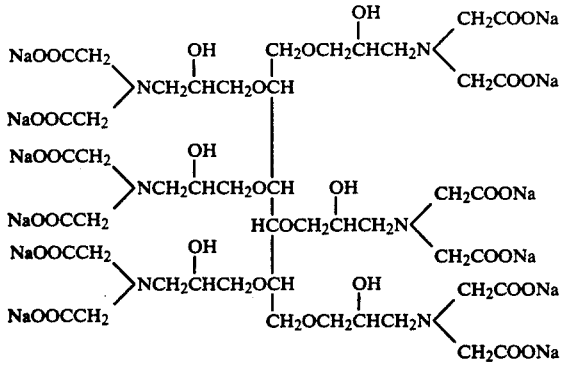

The compound represented by the general formula (I) or (II) is preferably used in an amount of $5\times10^{-7}$ to $5\times10^{-1}$ moles in the silver halide photographic material of the present invention, with the range of $5\times10^{-6}$ to $1\times10^{-2}$ mole being more preferred.

The compounds represented by the general formulas (I) and (II) can be synthesized by known methods.

Compounds that are preferably used as hydrazine derivatives in the present invention are represented by the following general formula (III), (IV) or (V):

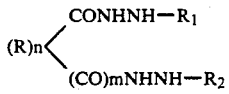

(III)

(where $R_1$ and $R_2$ are each an aryl or heterocyclic group; R is an organic bonding group; n is 0–6; m is 0 or 1; when n is 2 or more, R may be the same or different);

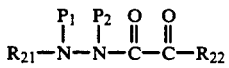

(IV)

(where $R_{21}$ is an aliphatic group, an aromatic group or a heterocyclic group; $R_{22}$ is a hydrogen atom, an optionally substituted alkoxy group, a hetero ring, an oxy group, an amino group or an aryloxy group; $P_1$ and P2 are each a hydrogen atom, an acyl group or a sulfinic acid group);

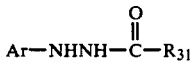

(V)

(where Ar is an aryl group containing at least one non-diffusible group or at least one group capable of promoting adsorption on silver halide; $R_{31}$ is a substituted alkyl group).

The general formulas (III), (IV) and (V) are described below more specifically:

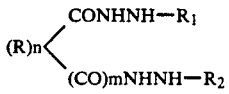

(III)

where $R_1$ and $R_2$ are each an aryl group or a heterocyclic group; R is a divalent organic group: n is 0–6; and m is 0 or 1.

Examples of the aryl group represented by $R_1$ and $R_2$ include phenyl and naphthyl; examples of the heterocyclic group represented by $R_1$ and $R_2$ include pyridyl, benzothiazolyl, quinolyl and thienyl; $R_1$ and $R_2$ are preferably an aryl group. Various substituents can be introduced into the aryl or heterocyclic group represented by $R_1$ and $R_2$. Illustrative substituents include: a halogen atom (e.g. Cl or F), an alkyl group (e.g. methyl, ethyl or dodecyl), an alkoxy group (e.g. methoxy, ethoxy, isopropoxy, butoxy, octyloxy or dodecyloxy), an acylamino group [e.g. acetylamino, pivalylamino, benzoylamino, tetradecanoylamino, or α-(2,4-di-t-amylphenoxy)butyrylamino], a sulfonylamino group (e.g. methanesulfonylamino, butanesulfonylamino, dodecanesulfonylamino, or benzenesulfonylamino), a urea group (e.g. phenylurea or ethylurea), a thiourea group (e.g. phenylthiourea or ethylthiourea), a hydroxy group, an amino group, an alkylamino (e.g. methylamino or dimethylamino), a carboxy group, an alkoxycarbonyl group (e.g. ethoxycarbonyl), a carbamoyl group, and a sulfo group.

Examples of the divalent organic group represented by R include an alkylene group (e.g. methylene, ethylene, trimethylene or tetramethylene), an arylene group (e.g. phenylene or naphthylene) and an aralkylene group which may contain an oxy group, a thio group, a seleno group, a carbonyl group,

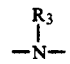

(where $R_3$ is a hydrogen atom, an alkyl group or an aryl group), a sulfonyl group, etc. in the bond. Various substituents may be introduced into the group represented by R and illustrative substituents include —CONHNHR$_4$ (where $R_4$ has the same meaning as $R_1$ and $R_2$ defined above), an alkyl group, an alkoxy group, a halogen atom, a hydroxy group, a carboxy group, an acyl group, an aryl group, etc. An alkylene group is preferred as R.

Preferred compounds of the general formula (III) are such that $R_1$ and $R_2$ are each a substituted or unsubstituted phenyl group, n=m=1, and R is an alkylene group.

Typical examples of the compounds represented by the general formula (III) are listed below.

III-1

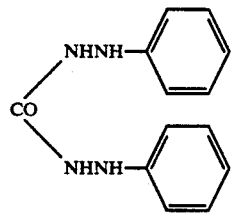

III-2

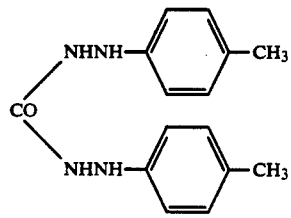

-continued
III-3
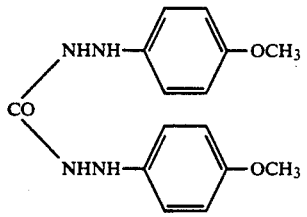
III-4
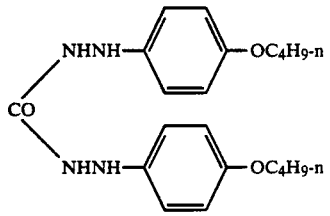
III-5
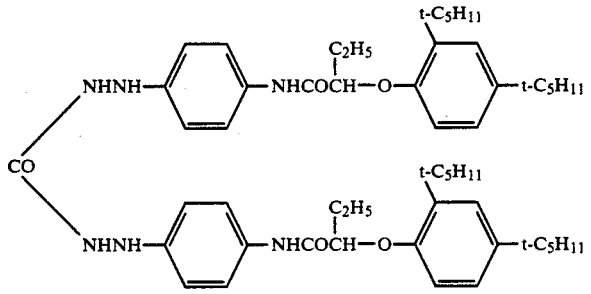
III-6
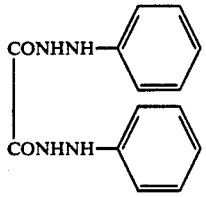
III-7
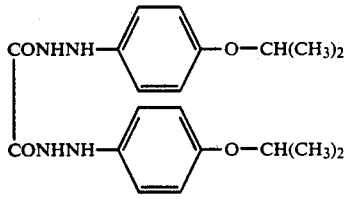
III-8
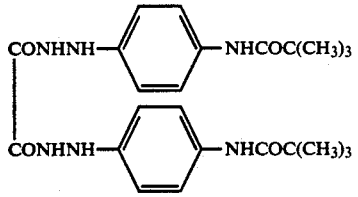
III-9
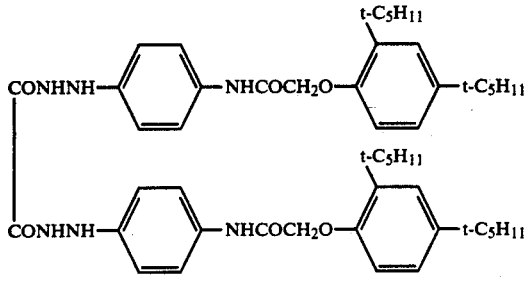

-continued
III-10
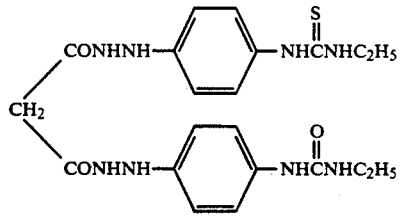
III-11
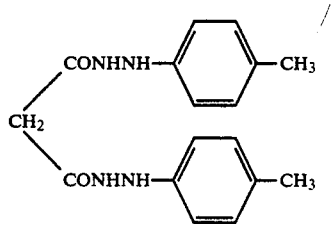
III-12
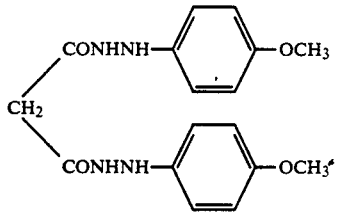
III-13
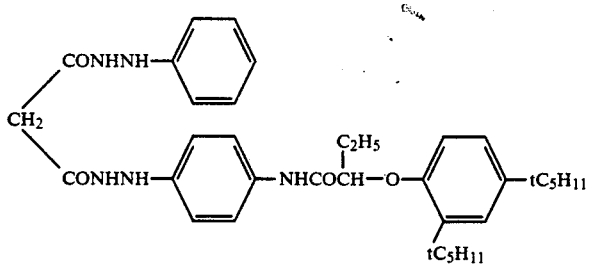
III-14
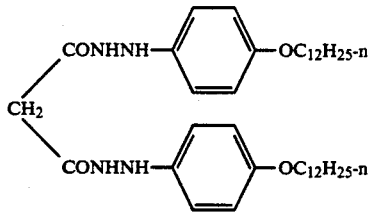
III-15
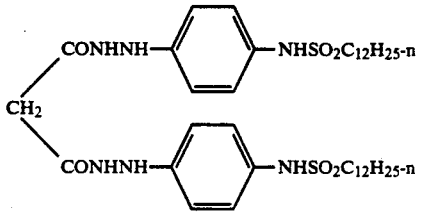

-continued
III-16
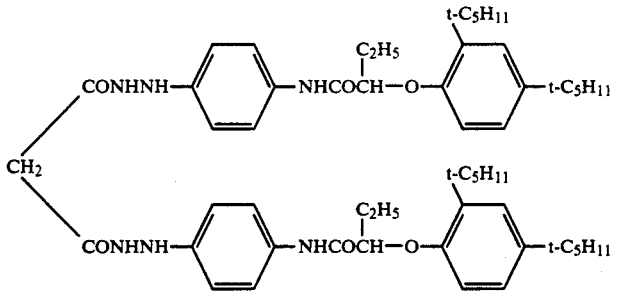
III-17
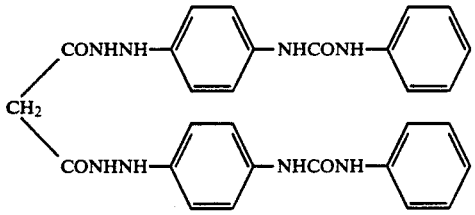
III-18
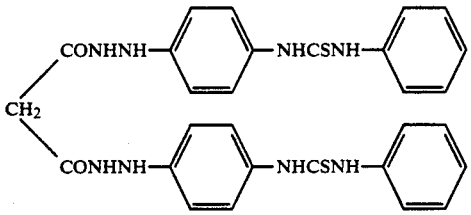
III-19
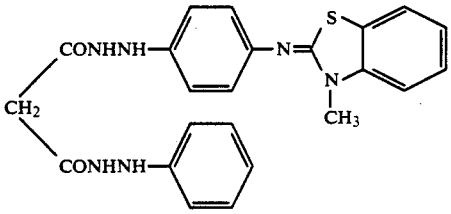
III-20
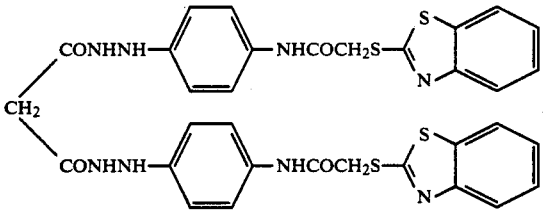
III-21
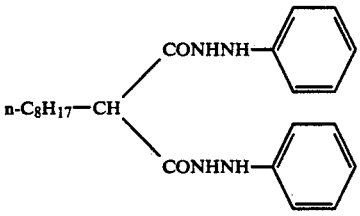
III-22
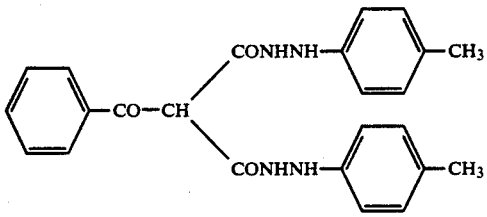

-continued
III-23
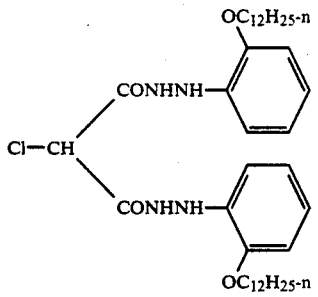
III-24
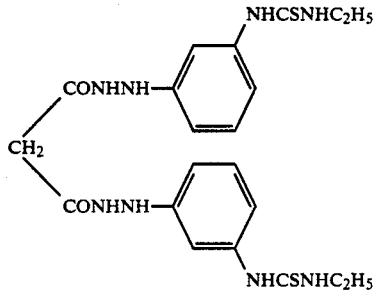
III-25
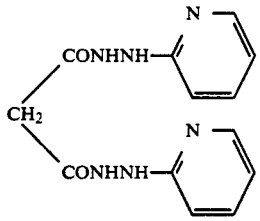
III-26
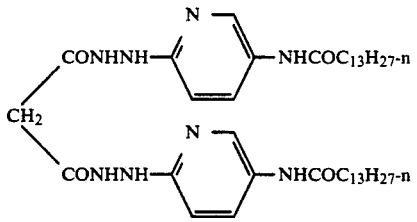
III-27
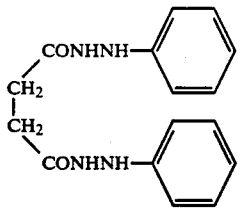
III-28
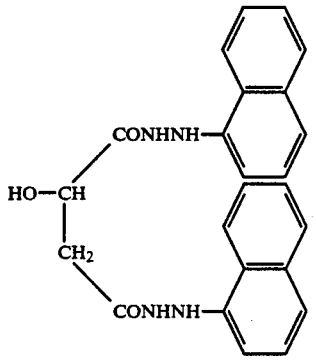

-continued
III-29
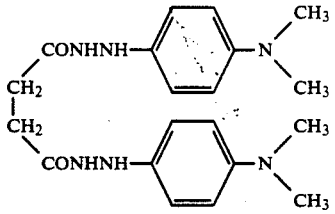
III-30
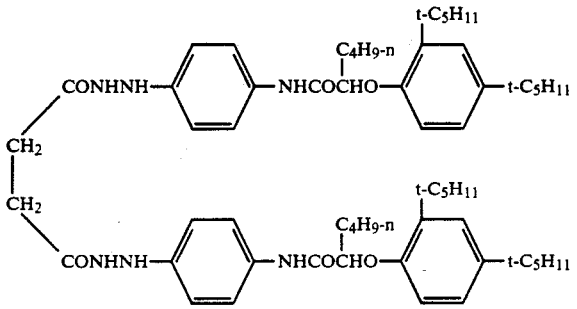
III-31
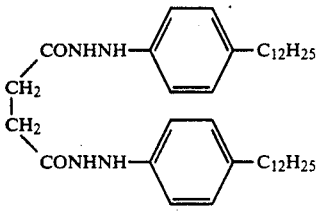
III-32
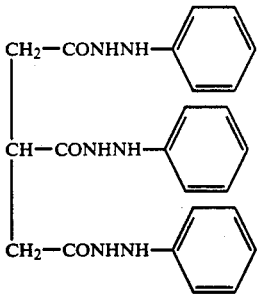
III-33
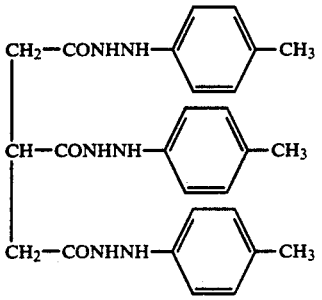

-continued
III-34
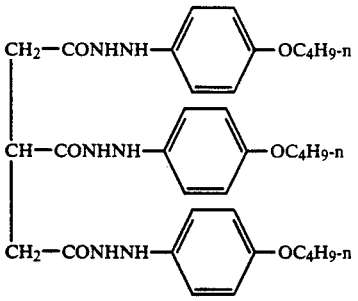
III-35
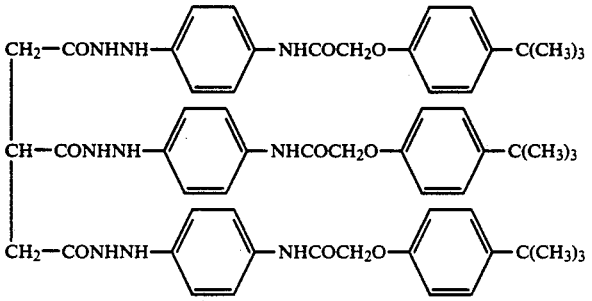
III-36
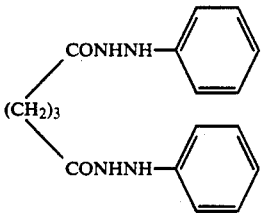
III-37
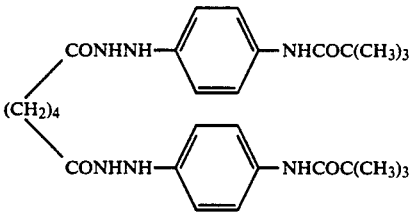
III-38
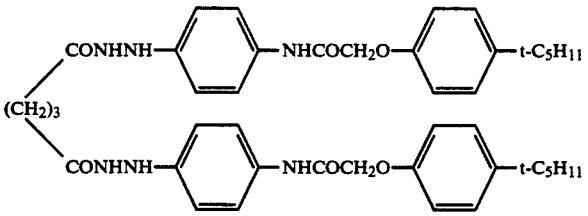
III-39
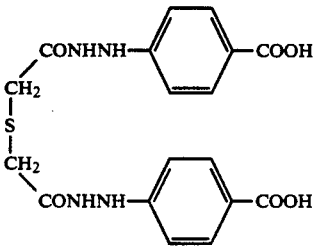

-continued
III-40
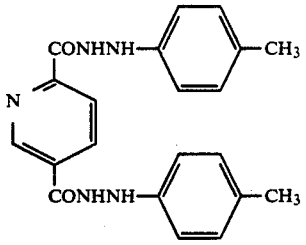
III-41
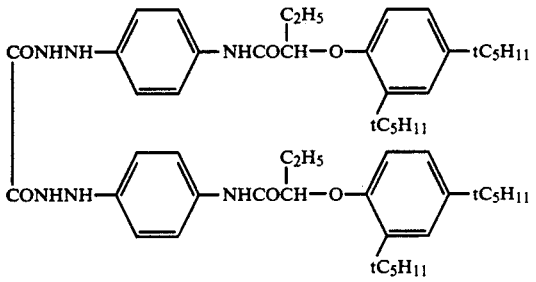
III-42
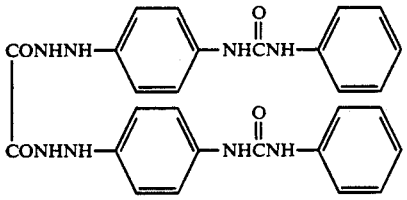
III-43
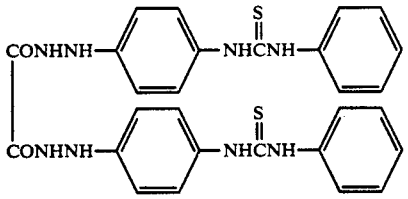
III-44
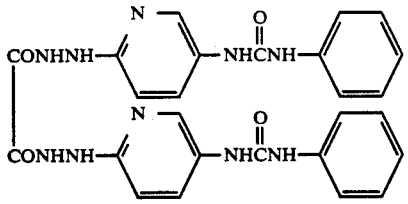
III-45
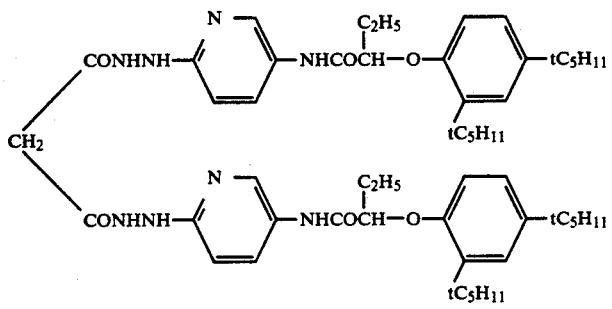

-continued
III-46
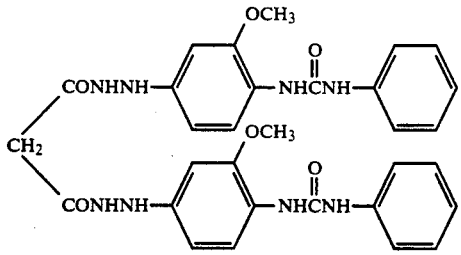
III-47
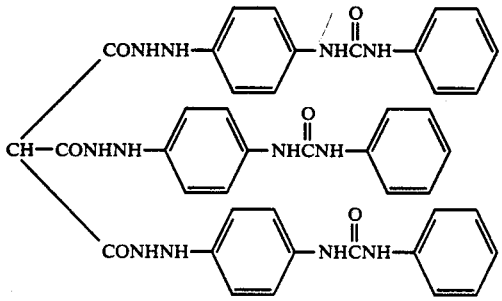
III-48
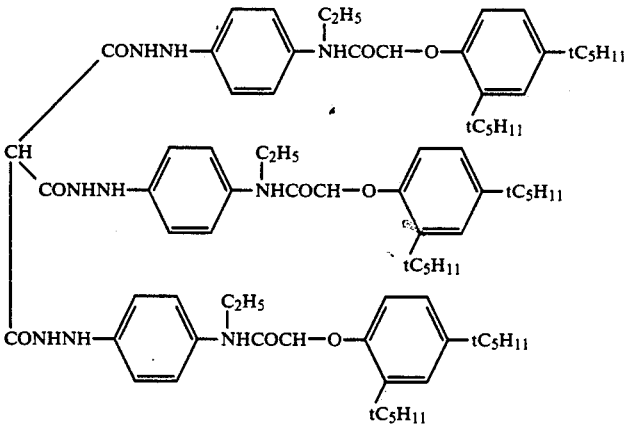
III-49
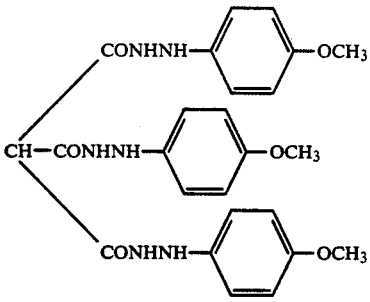
III-50
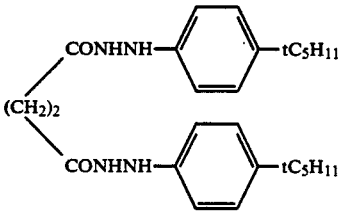

-continued

III-51

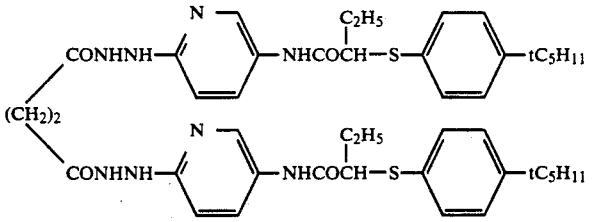

III-52

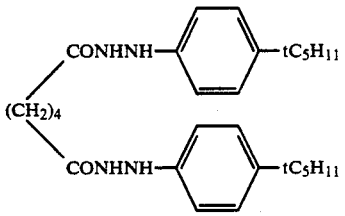

III-53

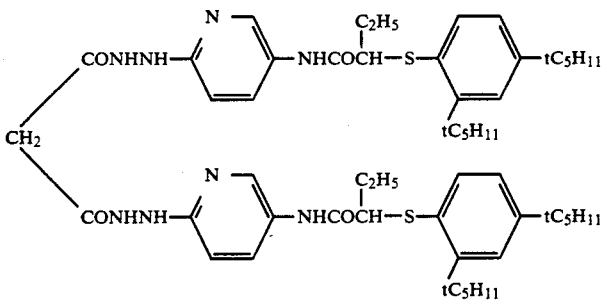

III-54

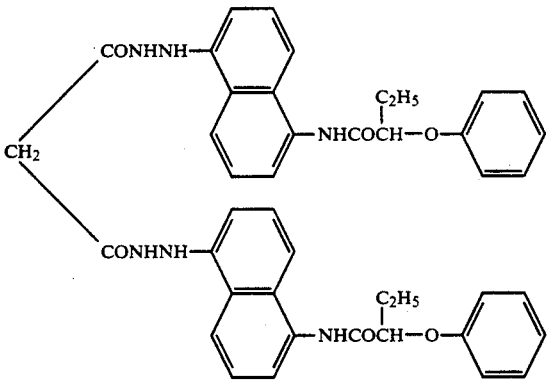

III-55

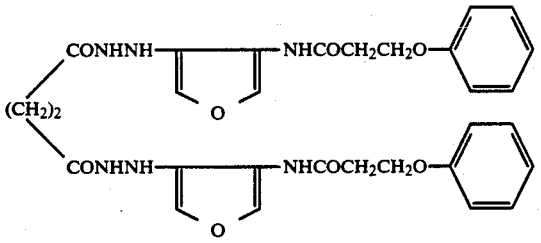

The general formula (IV) is described below:

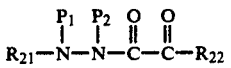

(IV)

The aliphatic group represented by $R_{21}$ is preferably one having at least 6 carbon atoms, with a straight-chained, branched or cyclic alkyl group of 8–50 carbon atoms being particularly preferred. The branched alkyl group may be cyclized to form a saturated hetero ring containing one or more hetero atoms. The alkyl groups represented by $R_{21}$ may contain a substituent such as an aryl group, an alkoxy group or a sulfoxy group.

The aromatic group represented by $R_{21}$ is a monocyclic or bicyclic aryl group or an unsaturated heterocyclic group. The unsaturated heterocyclic group may be condensed with a monocyclic or bicyclic aryl group to form a heteroaryl group. Examples of the aromatic group represented by $R_{21}$ are those including a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring, and those including a benzene ring are particularly preferred.

A particularly preferred example of $R_{21}$ is an aryl group. The aryl group or unsaturated heterocyclic group represented by $R_{21}$ may be substituted and typical substituents include a straight-chained, branched or cyclic alkyl group (preferably a monocyclic or bicyclic alkyl having 1-20 carbon atoms), an alkoxy group (preferably having 1-20 carbon atoms), a substituted amino group (preferably an amino group substituted by an alkyl group having 1-20 carbon atoms), an acylamino group (preferably having 2-30 carbon atoms), a sulfonamido group (preferably having 1-30 carbon atoms), and a ureido group (preferably having 1-30 carbon atoms).

The substituted or unsubstituted alkoxy group represented by $R_{22}$ in the general formula (IV) is preferably one having 1-20 carbon atoms, which may be substituted by a halogen atom, an aryl group, etc.

The substituted or unsubstituted aryloxy group or the heterocycloxy group that are represented by $R_{22}$ in the general formula (IV) is preferably monocyclic and exemplary substituents include a halogen atom, an alkyl group, an alkoxy group and a cyano group.

Preferred examples of the groups represented by $R_{22}$ are a substituted or unsubstituted alkoxy or amino group. In the case of an amino group, it is represented by

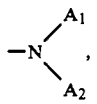

where $A_1$ and $A_2$ are each a substituted or unsubstituted alkyl or alkoxy group, or a cyclic structure containing —O—, —S— or —N— bond. It should be noted that $R_{22}$ is in no case a hydrazine group.

In the general formula (IV), $R_{21}$ or $R_{22}$ may have a ballast group incorporated therein and the ballast group may be of any kind that is commonly used in couplers and other immobilized photographic additives. The ballast group is a group that is comparatively inert to photographic properties and that has at least 8 carbon atoms, and it may be selected from among alkyl, alkoxy, phenyl, alkylphenyl, phenoxy, alkylphenoxy, etc.

A group that enhances adsorption on the surfaces of silver halide grains may be incorporated into $R_{21}$ or $R_{22}$ in the general formula (IV). Such adsorbing groups include thiourea, heterocyclic thioamido, mercaptoheterocyclic, triazole and other groups that are described in U.S. Pat. No. 4,355,105. Among the compounds represented by the general formula (IV). those which are represented by the following general formula (IV-a) are particularly preferred:

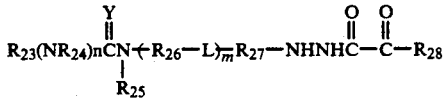

(IV-a)

In the general formula (IV-a), $R_{23}$ and $R_{24}$ are each a hydrogen atom, an optionally substituted alkyl group (e.g. methyl, ethyl, butyl, dodecyl, 2-hydroxypropyl, 2-cyanoethyl or 2-chloroethyl), an optionally substituted phenyl group, a naphthyl group, a cyclohexyl group, a pyridyl group, or a pyrrolidyl group (e.g. phenyl, p-methylphenyl, naphthyl, α-hydroxynaphthyl, cyclohexyl, p-methylcyclohexyl, pyridyl, 4-propyl-2-pyridyl, pyrrolidyl or 4-methyl-pyrrolidyl); $R_{25}$ represents a hydrogen atom or an optionally substituted benzyl, alkoxy or alkyl group (e.g. benzyl, p-methylbenzyl, methoxy, ethoxy, ethyl or butyl); $R_{26}$ and $R_{27}$ are each a divalent aromatic group (e.g. phenylene or naphthylene); Y is a sulfur atom or an oxygen atom; L is a divalent bonding group (e.g. $—SO_2CH_2CH_2NH—SO_2NH$, $—OCH_2SO_2NH$, —O— or —CH=N—); $R_{28}$ is —R'R' or $—OR_{29}$ (where R', R' and $R_{29}$ each represents a hydrogen atom, an optionally substituted alkyl group (e.g. methyl, ethyl or dodecyl), an optionally substituted phenyl group (e.g. phenyl, p-methylphenyl or p-methoxyphenyl), an optionally substituted naphthyl group (e.g. α-naphthyl or β-naphthyl), or a heterocyclic group (e.g. an unsaturated heterocyclic group such as pyridine, thiophene or furan, or a saturated heterocyclic group such as tetrahydrofuran or sulfolane), provided that R' and R'' may combine with the nitrogen atom to form a ring (e.g. piperidine, piperazine or morpholine); m and n are each 0 or 1; when $R_{28}$ represents $—OR_{29}$, Y preferably represents a sulfur atom.

Typical examples of the compounds represented by the general formula (IV) and (IV-a) are listed below.

Illustrative compounds of the general formula (IV)

IV-1

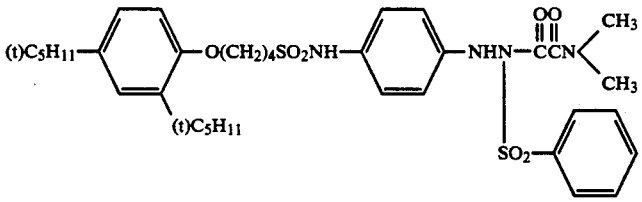

IV-2

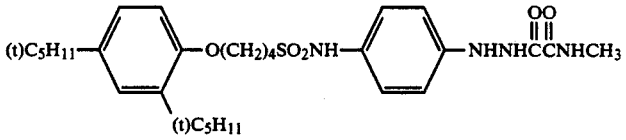

-continued
Illustrative compounds of the general formula (IV)
IV-3
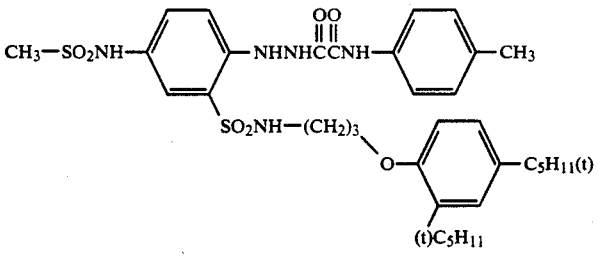
IV-4
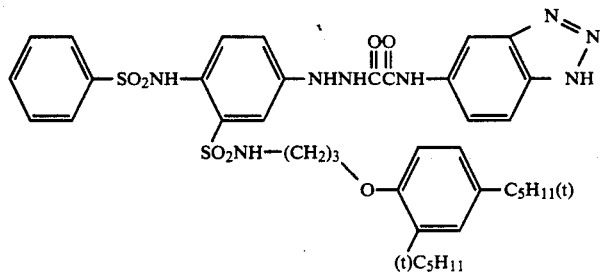
IV-5
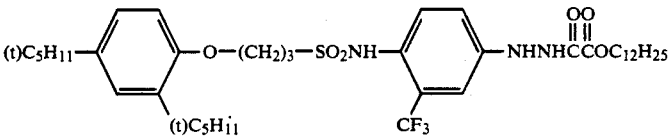
IV-6
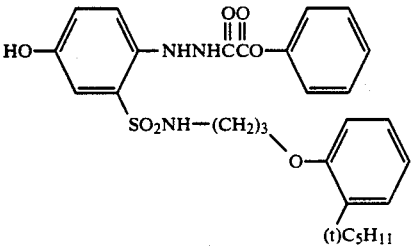
IV-7
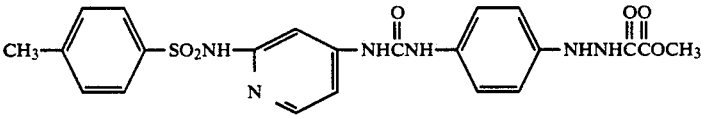
IV-8
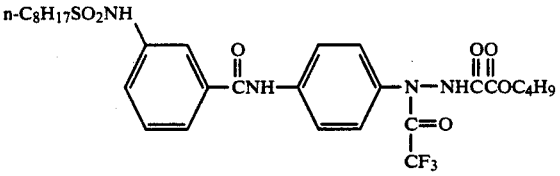
IV-9
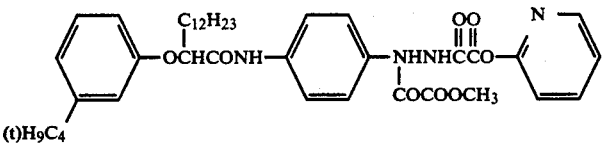
IV-10
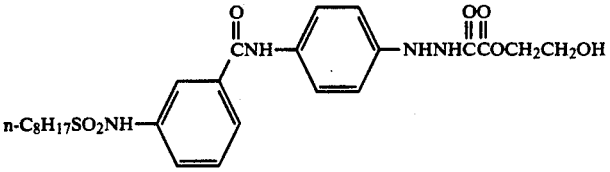

-continued
Illustrative compounds of the general formula (IV)
IV-11
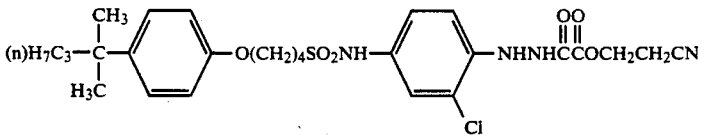
IV-12
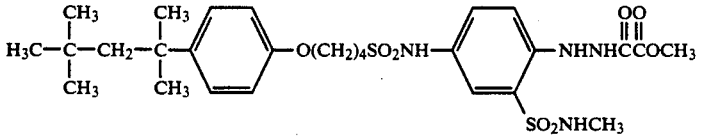
IV-13
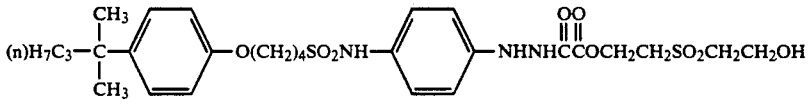
IV-14
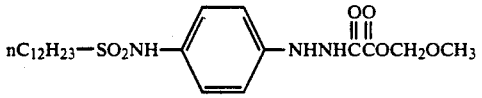
IV-15
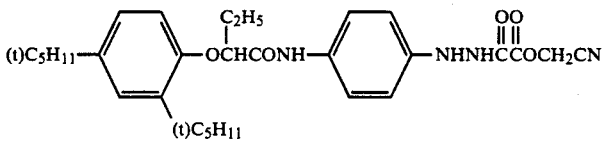
IV-16
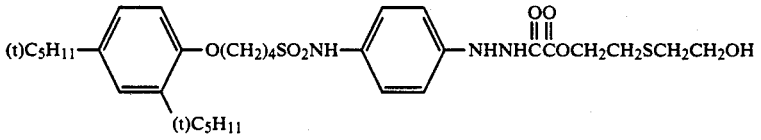
IV-17
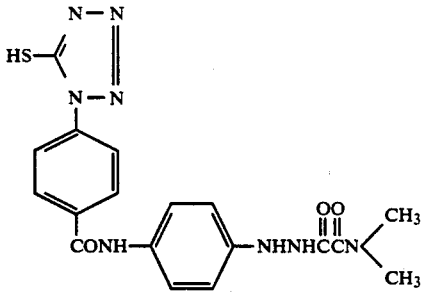
IV-18
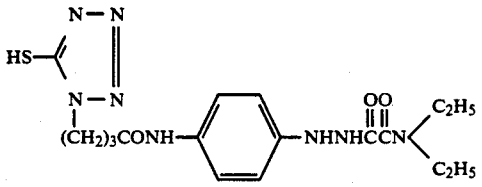

-continued
Illustrative compounds of the general formula (IV)
IV-19
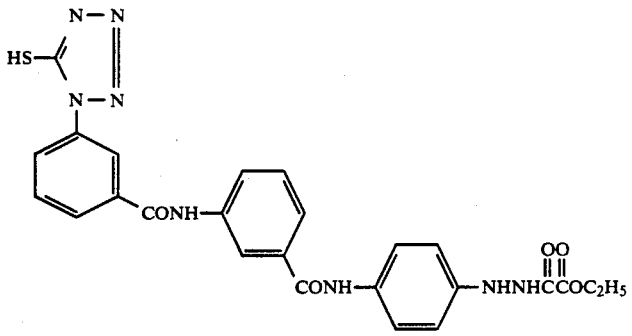
IV-20
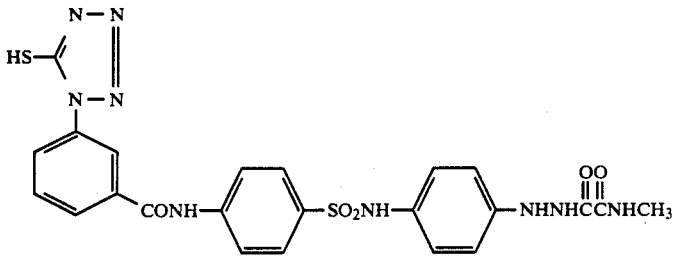
IV-21
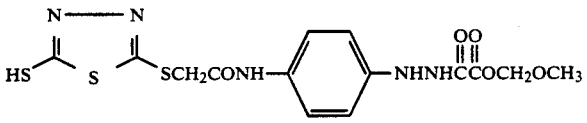
IV-22
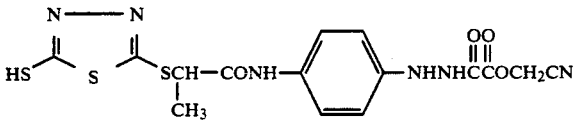
IV-23
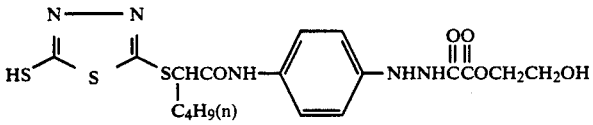
IV-24
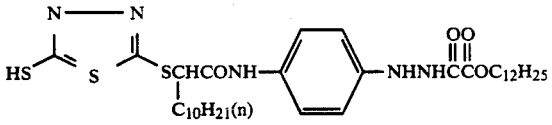
IV-25
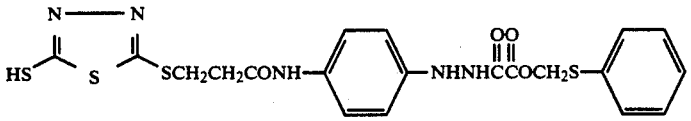
IV-26
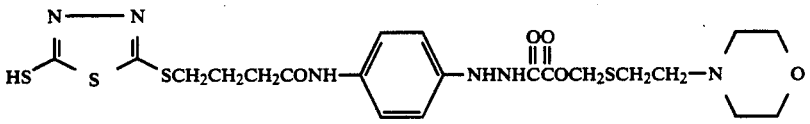
IV-27
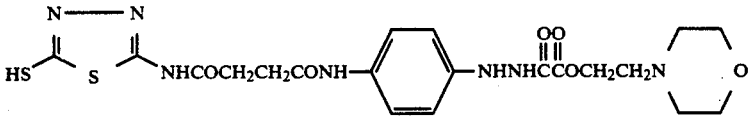

-continued
Illustrative compounds of the general formula (IV)
IV-28
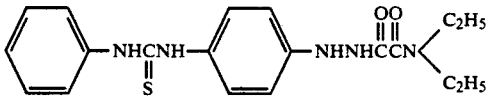
IV-29
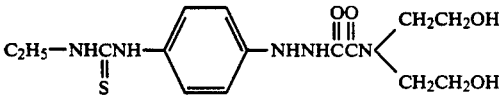
IV-30
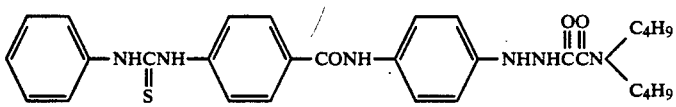
IV-31
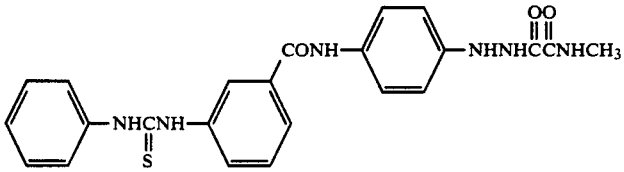
IV-32
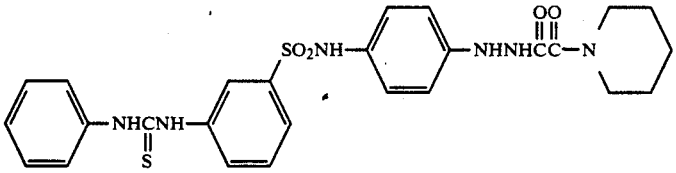
IV-33
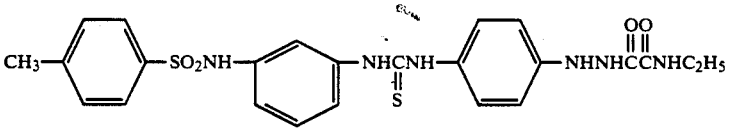
IV-34
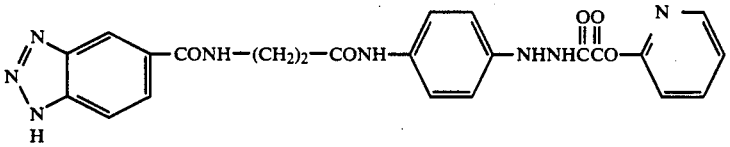
IV-35
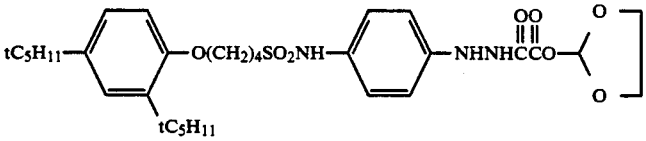
IV-36
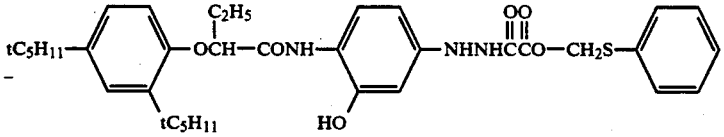
IV-37
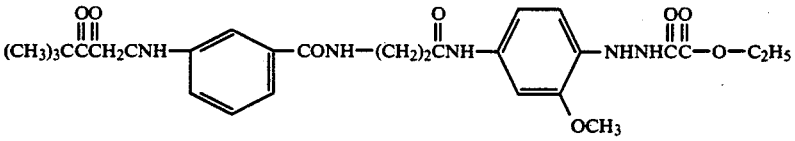

-continued
Illustrative compounds of the general formula (IV)
IV-38
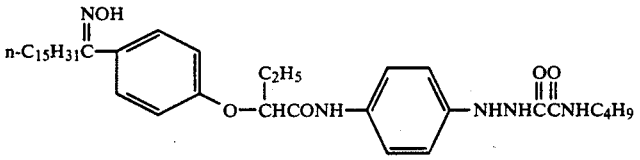
IV-39
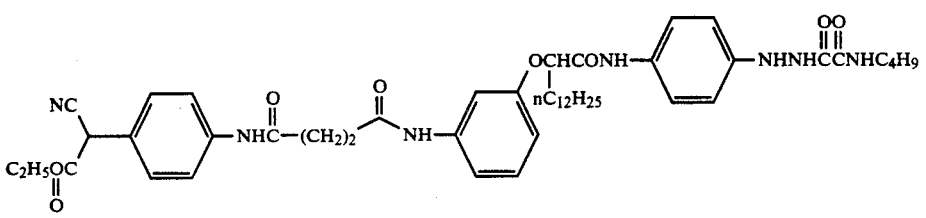
IV-40
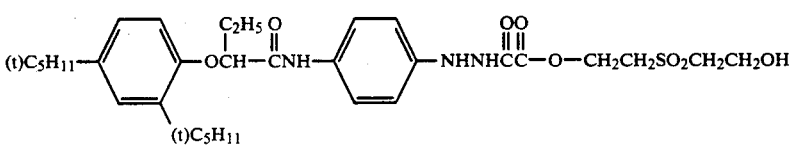
IV-41
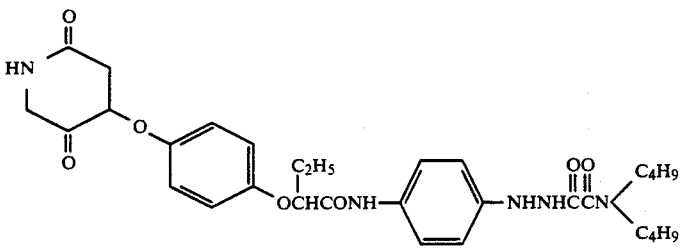
IV-42
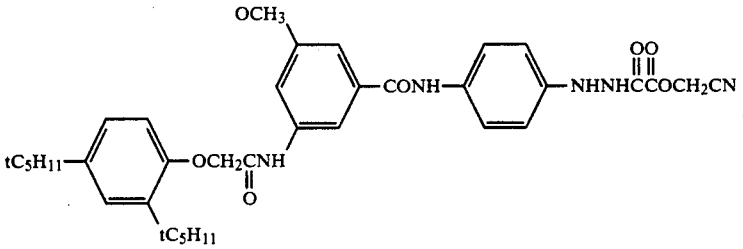
IV-43
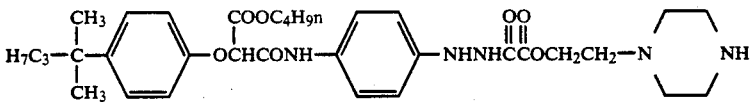
IV-44
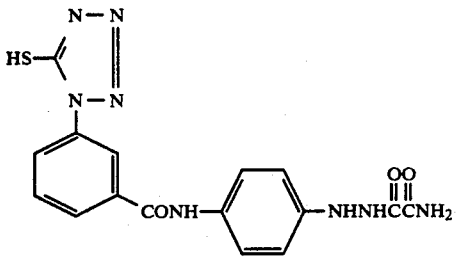
IV-45
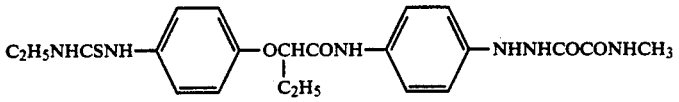

-continued
Illustrative compounds of the general formula (IV)
IV-46
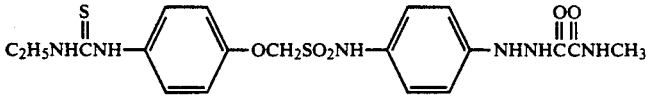
IV-47
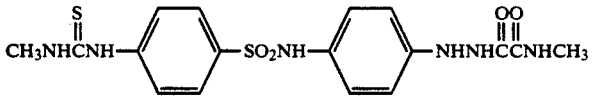
IV-48
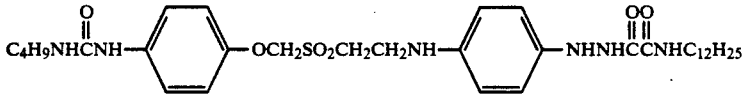
IV-49
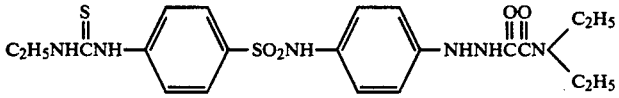
IV-50
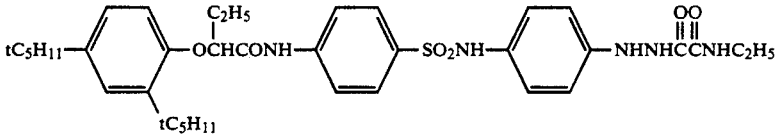
IV-51
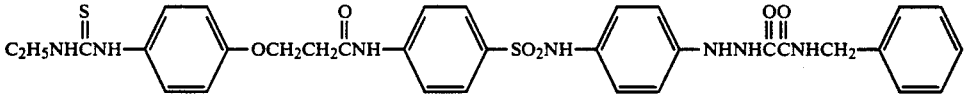
IV-52
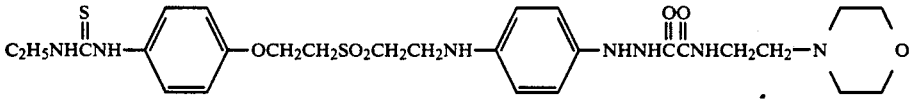
IV-53
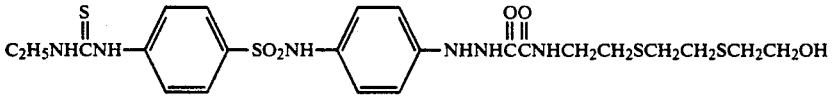
IV-54
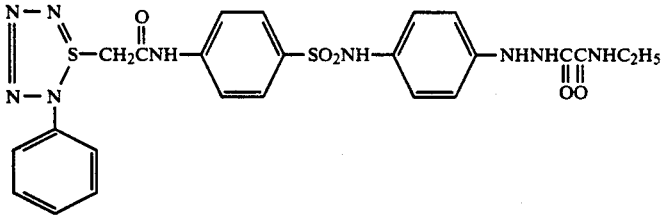
IV-55
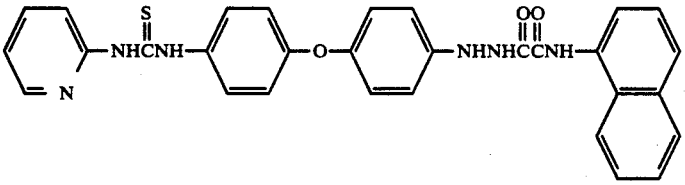
IV-56
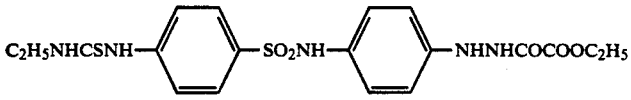

-continued
Illustrative compounds of the general formula (IV)
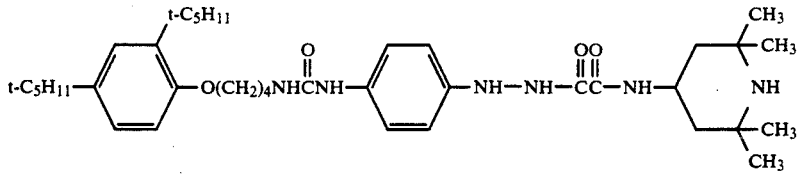
IV-57
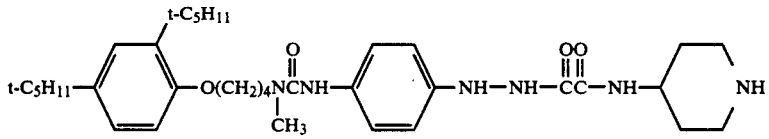
IV-58
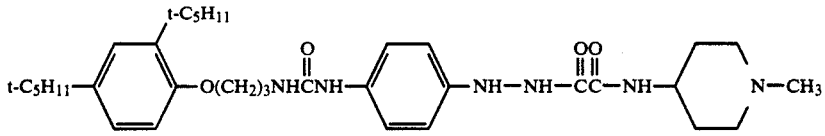
IV-59
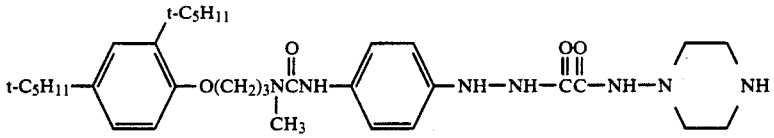
IV-60
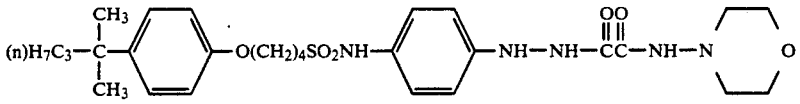
IV-61
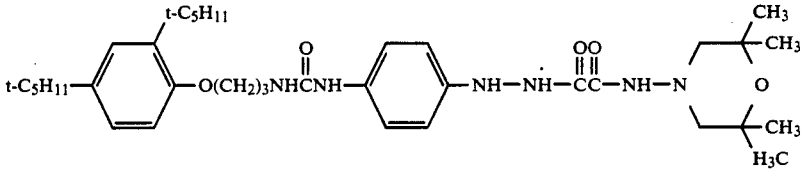
IV-62
Synthesis of the compounds listed above is described below with Compounds IV-45 and IV-47 being taken as examples.
Synthesis of Compound IV-45
Synthesis scheme:
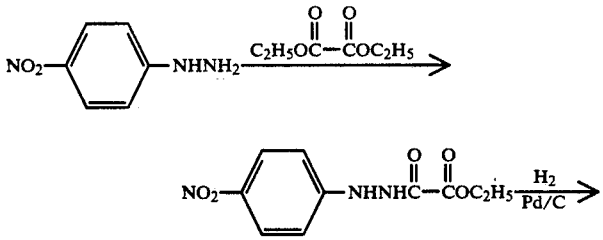
(A)
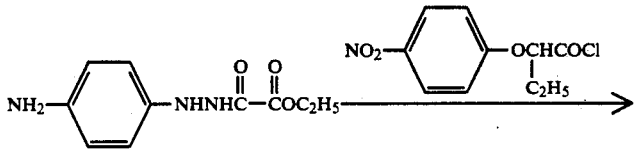
(B) (C)

-continued

Synthesis of Compound IV-45

Synthesis scheme:

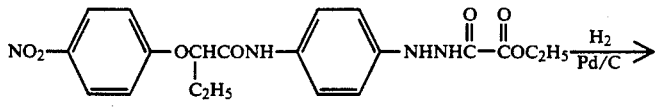

(D)

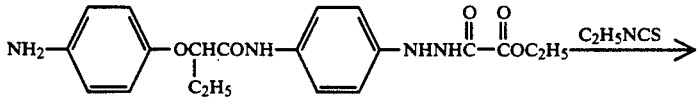

(E)

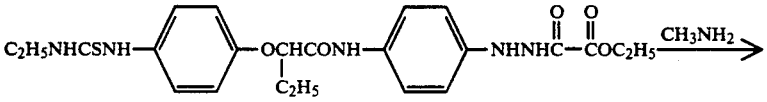

(F)

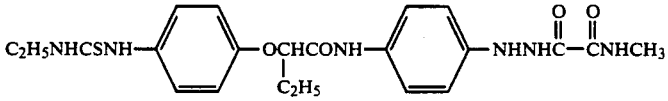

Compound IV-45

A mixture of 4-nitrophenylhydrazine (153 g) and diethyl oxalate (500 ml) is refluxed for 1 h. Ethanol is removed as the reaction proceeds. Finally, cooling is performed to crystallize the mixture. After filtration and several washings with petroleum ether, recrystallization is performed. A portion (50 g) of the resulting crystal (A) is dissolved in methanol (1,000 ml) under heating and the solution is reduced in a pressurized (50 psi) $H_2$ atmosphere in the presence of Pd/C (palladium on carbon) to obtain compound (B).

A portion (22 g) of the compound (B) is dissolved in a solution of acetonitrile (200 ml) and pyridine (60 g) and a solution of compound C (24 g) in acetonitrile is added dropwise. The insoluble matter is filtered off and the filtrate is concentrated, recrystallized and purified to obtain 31 g of compound (D).

A portion (30 g) of the compound (D) is hydrogenated in the same manner as described above to obtain 20 g of compound (E).

A portion (10 g) of the compound (E) is dissolved in 100 ml of acetonitrile and 3.0 g of ethyl isothiocyanate is added, followed by refluxing for 1 h. After distilling off the solvent, the residue is recrystallized and purified to obtain 7.0 g of compound (F). A portion (5.0 g) of the compound (F) is dissolved in 50 ml of methanol and methylamine (8 ml of 40% aq. sol.) is added, with the mixture being then stirred. After concentrating methanol to some extent, the precipitating solids are recovered, recrystallized and purified to obtain compound IV-47.

Synthesis of compound IV-47

Synthesis scheme:

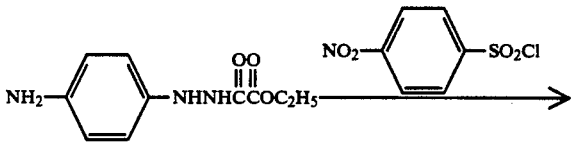

(B)

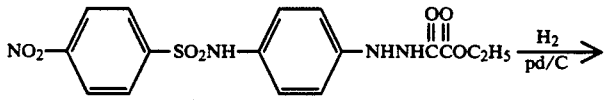

(C)

-continued

Synthesis of compound IV-47

Synthesis scheme:

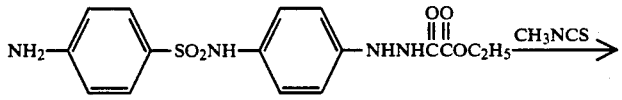

a(D)

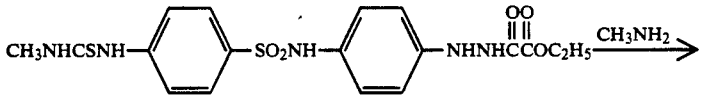

(E)

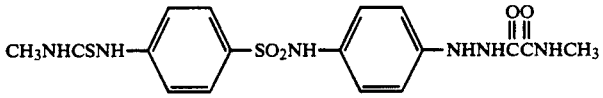

Compound IV-47

A portion (22 g) of compound (B) is dissolved in 200 ml of pyridine and to the stirred solution. 22 g of p-nitrobenzenesulfonyl chloride is added. The reaction mixture is poured into water and the precipitating solids are recovered to obtain compound (C). This compound (C) is treated in accordance with the scheme shown above to obtain compound IV-47 by performing reactions in the same way as in the preparation of compound IV-45.

The general formula (V) is described below:

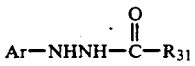

(V)

In the general formula (V), Ar is an aryl group containing at least one non-diffusible group or at least once group capable of promoting adsorption on silver halide. A preferred non-diffusible group is a ballast group commonly used in immobilized photographic additives such as couplers. A ballast group is a group that is comparatively inert to photographic properties and that has at least 8 carbon atoms. A suitable ballast group may be selected from among alkyl, alkoxy, phenyl, alkylphenyl, phenoxy, alkylphenoxy groups, etc. Examples of the group capable of promoting adsorption to silver halide include a thiourea group, a thiourethane group, a heterocyclic thioamido group, a mercaptoheterocyclic group, a triazole group and other groups that are described in U.S. Pat. No. 4,385,108.

In the general formula (V). $R_{31}$ represents a substituted alkyl group which may be straight-chained, branched or cyclic and exemplary alkyl groups include methyl, ethyl, propyl, butyl, isopropyl, pentyl and cyclohexyl. Various substituents may be introduced into these alkyl groups and they include: an alkoxy group (e.g. methoxy or ethoxy), an aryloxy group (e.g. phenoxy or p-chlorophenoxy), a heterocycloxy group (e.g. pyridyloxy), a mercapto group, an alkylthio group (e.g. methylthio or ethylthio), an arylthio group (e.g. phenylthio or p-chlorophenylthio), a heterocyclothio (e.g. pyridylthio, pyrimidylthio or thiadiazolylthio), an alkylsulfonyl group (e.g. methanesulfonyl or butanesulfonyl), an arylsulfonyl group (e.g. benzenesulfonyl), a heterocyclosulfonyl group (e.g. pyridylsulfonyl or morpholinosulfonyl), an acyl group (e.g. acetyl or benzoyl), a cyano group, a chlorine atom, a bromine atom, an alkoxycarbonyl group (e.g. ethoxycarbonyl or methoxycarbonyl), an aryloxycarbonyl group (e.g. phenoxycarbonyl), a carboxy group, a carbamoyl group, an alkylcarbamoyl group (e.g. N-methylcarbamoyl or N,N-dimethylcarbamoyl), an arylcarbamoyl group (e.g. N-phenylcarbamoyl), an amino group, an alkylamino group (e.g. methylamino or N,N-dimethylamino), an arylamino group (e.g. phenylamino or naphthylamino), an acylamino group (e.g. acetylamino or benzoylamino), an alkoxycarbonylamino group (e.g. ethoxy carbonylamino), an aryloxycarbonylamino (e.g. phenoxycarbonylamino), an acyloxy group (e.g. acetyloxy or benzoyloxy), an alkylaminocarbonyloxy group (e.g. methylaminocarbonyloxy), an arylaminocarbonyloxy group (e.g. phenylaminocarbonyloxy), a sulfo group a sulfamoyl group, an alkylsulfamoyl (e.g. methylsulfamoyl), an arylsulfamoyl group (e.g. phenylsulfamoyl), etc.

Hydrogen atoms in the hydrazine may be replaced by various substituents including a sulfonyl group (e.g. methanesulfonyl or toluenesulfonyl), an acyl group (e.g. acetyl or trifluoroacetyl) and an oxalyl group (e.g. ethoxalyl).

Typical examples of the compounds represented by the general formula (V) are listed below.

V-1

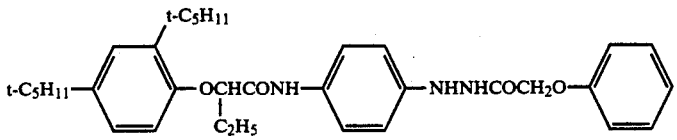

-continued
V-2
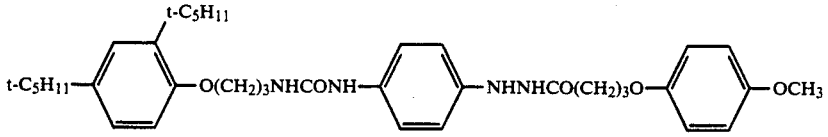
V-3
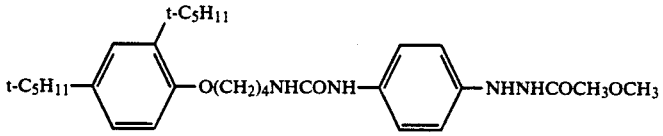
V-4
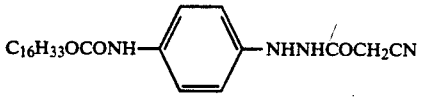
V-5
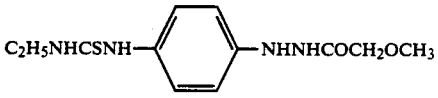
V-6
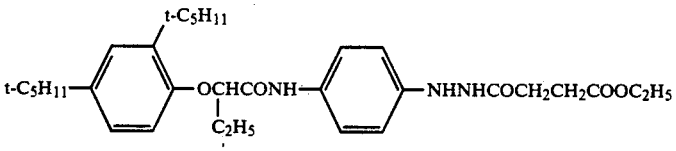
V-7
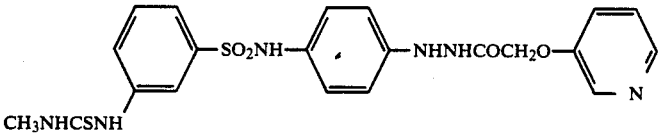
V-8
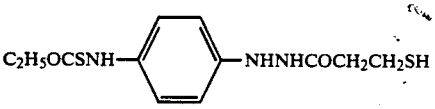
V-9
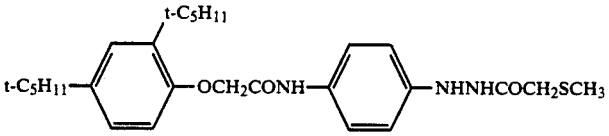
V-10
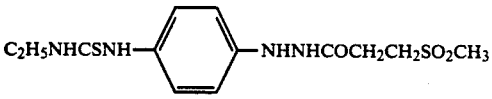
V-11
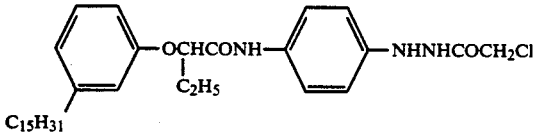
V-12
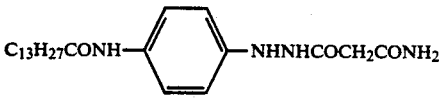
V-13
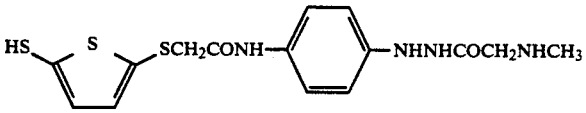

-continued
V-14
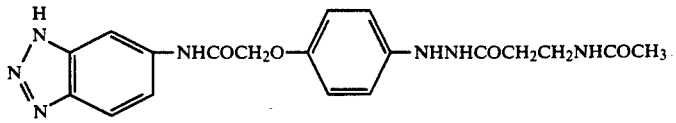
V-15
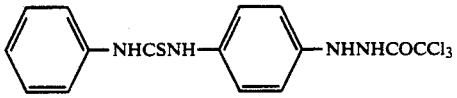
V-16
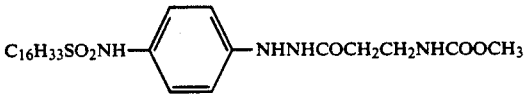
V-17
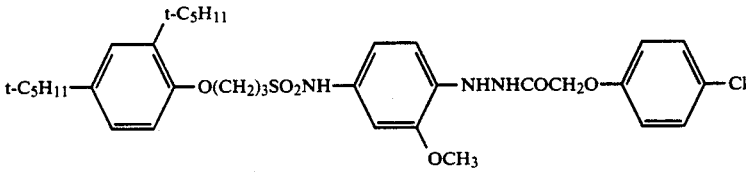
V-18
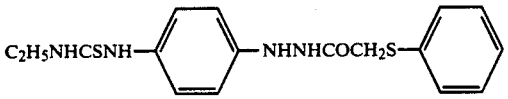
V-19
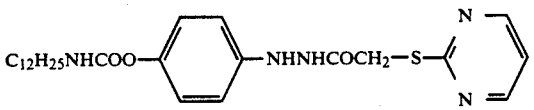
V-20
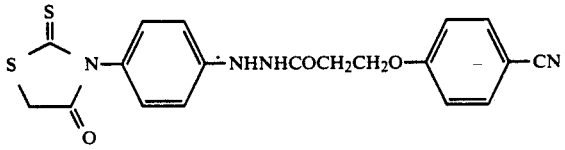
V-21
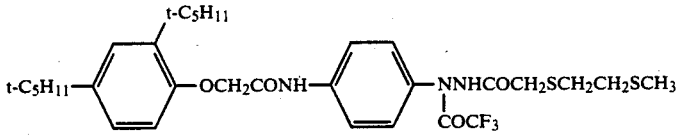
V-22
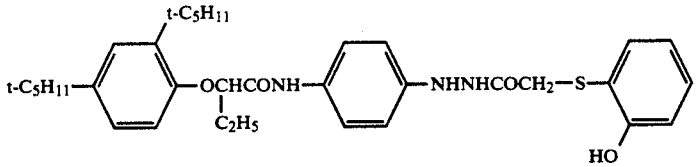
V-23
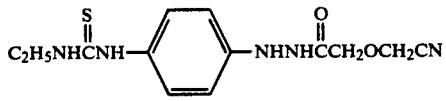
V-24
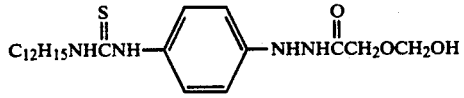
V-25
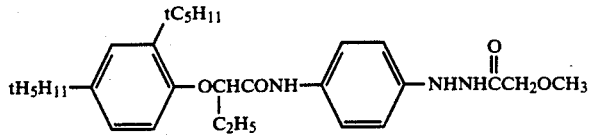

-continued
V-26
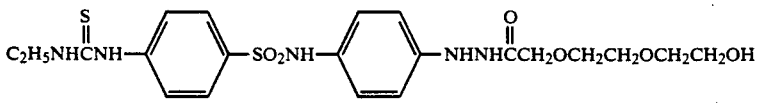
V-27
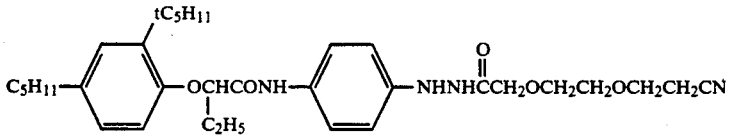
V-28
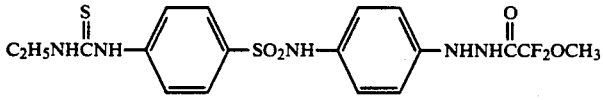
V-29
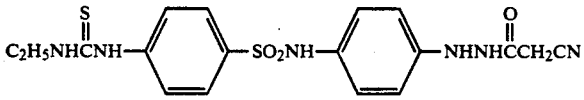
V-30
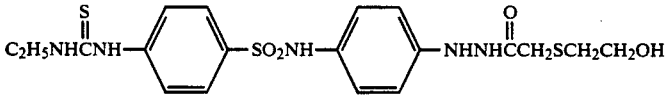
V-31
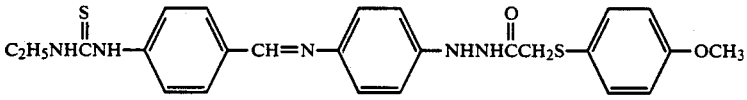
V-32
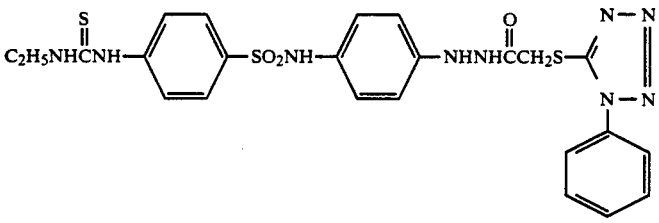
V-33
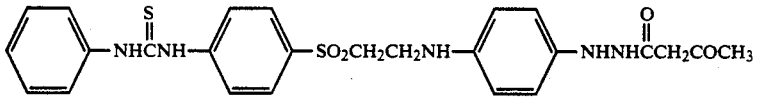
V-34
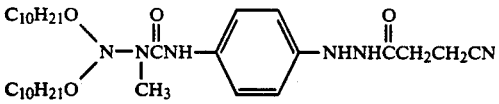
V-35
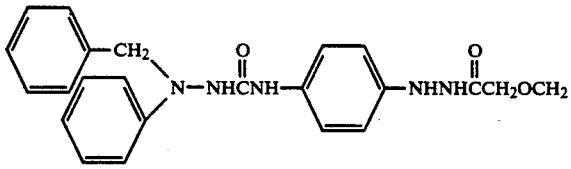
V-36
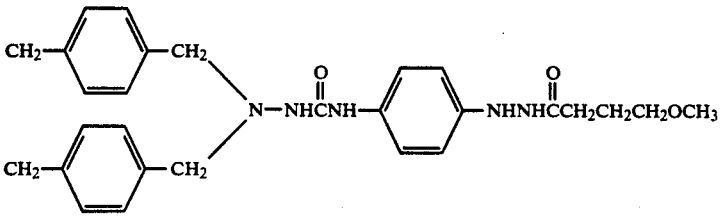

-continued
V-37
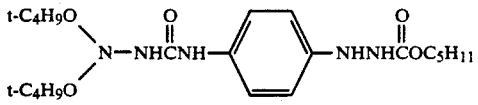
V-38
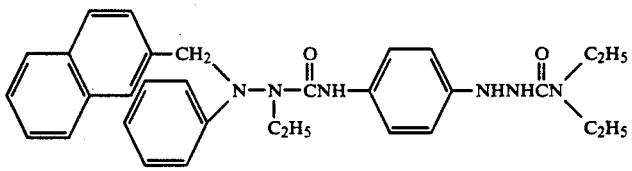
V-39
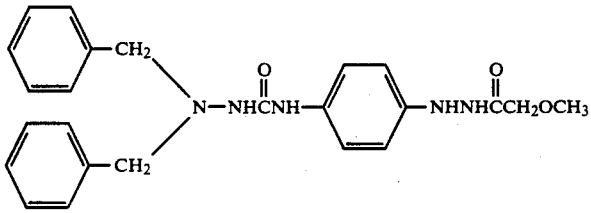
V-40
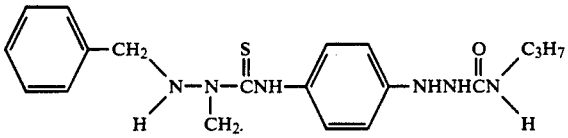
V-41
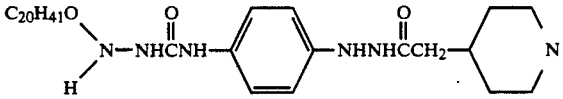
V-42
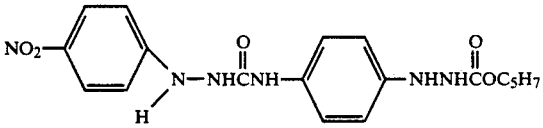
V-43
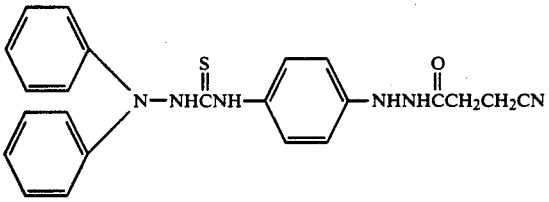
V-44
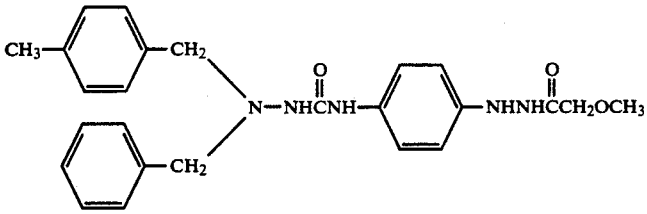
V-45
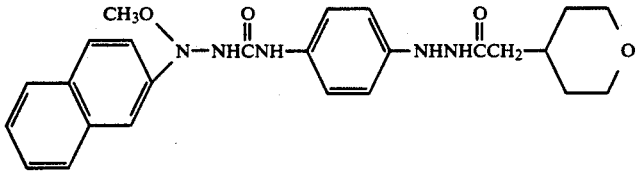

-continued

V-46

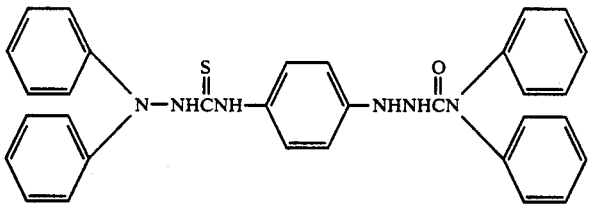

V-47

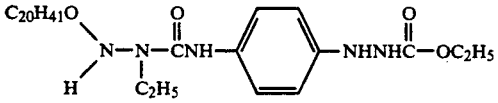

V-48

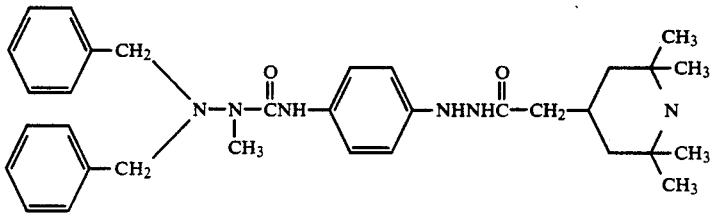

V-49

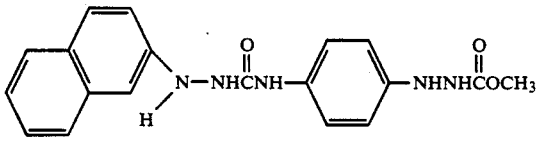

V-50

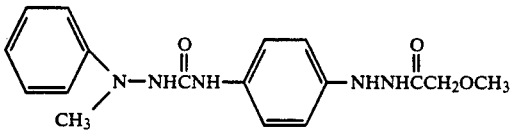

Synthesis of compound V-5 is described below.

Synthesis of compound V-5
synthesis scheme:

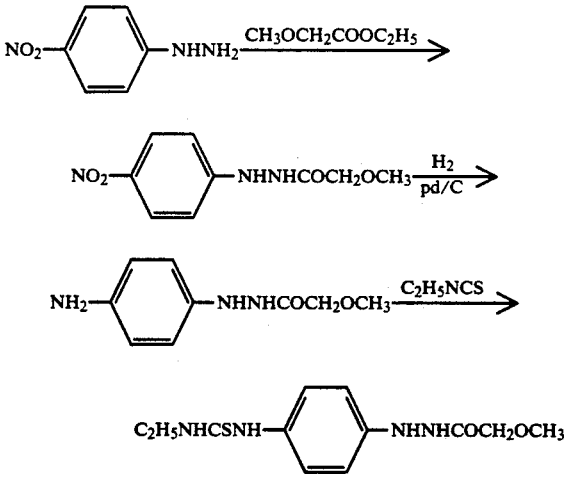

Compound V-5 is obtained in accordance with the method of synthesis of compound IV-4B.

The amount of the compound of the general formula III], [IV] or V] that is contained in the photographic material of the present invention preferably ranges from $5\times10^{-7}$ to $5\times10^{-1}$ moles per mole of the silver halide contained in said photographic material, with the range of $5\times10^{-6}$ to $1\times10^{-2}$ being particularly preferred.

The silver halide photographic material must also have at least one silver halide emulsion layer. At least one silver halide emulsion layer may be provided on at least one side of a support or it may be provided on both sides of the support. The silver halide emulsion layer may be coated directly on the support or it may be coated with another layer being interposed such as a hydrophilic colloidal layer that does not contain a silver halide emulsion. If necessary, the silver halide emulsion layer may be overcoated with a hydrophilic colloidal layer as a protective layer. The silver halide emulsion layer may be divided into sub-layers having different degrees of sensitivity, such as a high-sensitivity sub-layer and a low-sensitivity sub-layer. In this case, an intermediate layer such as one composed of a hydrophilic colloid may be provided between sub-layers. If desired, a non-light-sensitive hydrophilic colloidal layer may be provided between the silver halide emulsion layer and the protective layer and examples of such non-light-sensitive hydrophilic colloidal layers include an intermediate layer, a protective layer, an anti-halo layer and a backing layer.

The compound represented by the general formula (III), (IV) or (V) is incorporated in the silver halide emulsion layer and/or an adjacent hydrophilic colloidal layer in the silver halide photographic material. At least one of the compounds represented by the general formulas (I) and (II) is incorporated in the silver halide emulsion layer or hydrophilic colloidal layers, preferably in the emulsion layer or an adjacent layer thereto.

The silver halide to be used in the silver halide photographic material of the present invention is described below.

Any silver halide composition may be used, as exemplified by silver chloride, silver chlorobromide, silver chloroiodobromide, pure silver bromide or silver iodobromide. Silver halide grains preferably have an average grain size of 0.05–0.5 μm, with the range of 0.10–0.40 μm being particularly preferred.

The silver halide grains to be used in the present invention may have any size distribution but those having a value of 1–30 for monodispersity as defined below are preferred. More preferably, the value of monodispersity is adjusted to lie within the range of 5–20.

The term "monodispersity" as used hereinabove is defined as the standard deviation of a grain size that is divided by the average grain size and multiplied by 100. The size of a silver halide grain is conveniently expressed by the length of one side if it is a cubic grain and by the square root of the projected area if it is in other crystal forms (e.g. octahedra and tetradecahedra).

In the practice of the present invention, silver halide grains having a two or more layered structure may be used. For instance, core/shell silver iodobromide grains may be used, with the core being made of silver iodobromide and the shell being made of silver bromide. In this case, iodine may be incorporated in any layer in an amount not exceeding 5 mol %.

In the process of forming and/or growing silver halide grains to be used in a silver halide emulsion, metal ions may be added using at least one metal salt selected from among a cadmium salt, a zinc salt, a lead salt a thallium salt, an iridium salt (or a complex salt thereof), a rhodium salt (or a complex salt thereof) and an iron salt (or a complex salt thereof), whereby these metals in elemental form are incorporated in the interior and/or surface of the grains. If desired, the grains may be placed in a suitable reducing atmosphere in order to impart reduction sensitization nuclei to the interior and/or surface of the grains.

Silver halides may be sensitized with various chemical sensitizers. Exemplary chemical sensitizers include: activated gelatin; sulfur sensitizers (e.g. sodium thiosulfate, allyl thiocarbamide, thiourea and allyl isothiocyanate); selenium sensitizers (e.g. N,N-dimethylselenourea and selenourea); reduction sensitizers (e.g. triethylenetetramine and stannous chloride); and noble metal sensitizers (e.g. potassium chloroaurite, potassium aurithiocyanate, potassium chloroaurate, 2-aurosulfobenzothiazole methyl chloride, ammonium chloropalladate, potassium chloroplatinate, and sodium chloropalladite). These chemical sensitizers may be used either on their own or as admixtures. When gold sensitizers are to be used, ammonium thiocyanate may be used as an aid.

Silver halide grains to be used in the present invention may preferably be applied as those having a higher sensitivity in the surface than in the interior in order to provide negative image. Hence, their performance can be enhanced by treatment with the chemical sensitizers described above.

In the present invention, the hydrazine compound is contained in an emulsion layer or an adjacent layer, and the emulsion is preferably one treated with a modified gelatin for removal by coagulation-precipitation of dissolved matters from the emulsion. The modified gelatin is a gelatin coagulant being a high molecular coagulant capable of coagulating silver halide grains together with the protective colloid, and is specifically one in which at least 50% of amino groups in gelatin molecule are substituted with such substituents as mentioned in U.S. Pat. Nos. 2,691,582, 2,614,928 and 2,525,753.

Examples of the substituent are:

(1) acyl groups like alkylacyl, arylacyl, acetyl and substituted or unsubstituted benzoyl;
(2) carbamoyl groups like alkylcarbamoyl and arylcarbamoyl;
(3) sulfonyl groups like alkylsulfonyl and arylsulfonyl;
(4) thiocarbamoyl groups like alkylthiocarbamoyl and arylthio-carbamoyl;
(5) straight or branched alkyl groups having 1–18 carbon atoms; and
(6) arkyl groups like substituted or unsubstituted phenyl, naphthyl, aromatic heterocylics including pyridyl and furil.

Among the above, preferable modified gelatins are those substituted with acyl group ($-COR_1$) or carbamoyl group $$(-\underset{\underset{R_2}{|}}{CONR_1}),$$

in which $R_1$ represents a substituted or an unsubstituted aliphatic group (e.g. alkyl having 1–18 carbon atoms and alkyl), arkyl group or aralkyl group (e.g. phenethyl group) and $R_2$ represents hydrogen atom, alphatic, aryl or aralkyl group. Especially preferable ones are $R_1$ is an arkyl group and $R_2$ is hydrogen atom.

The followings are examples of the gelatin coagulant used in the present invention represented in terms of the substituent amino group;

$-COC_4H_9(t)$ G-1

$-COCH_3$ G-2

G-3

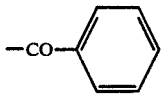

G-4

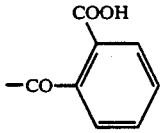

G-5

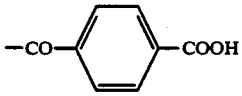

G-6

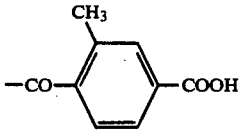

G-7

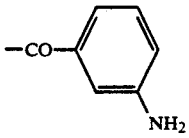

-continued

G-8

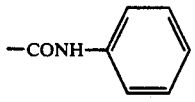

G-9

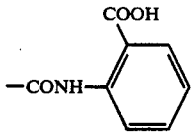

G-10

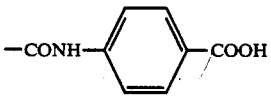

G-11

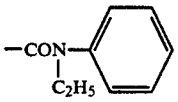

G-12

$-CONHCH_3$

The gelatin coagulant may be incorporated at any steps for preparing silver halide photographic emulsions, but is employed preferably after the desalting step, more preferably at the desalting step, for an effective addition of not causing the soft gradation of photographic capability. The amount of gelatin coagulant to be added is not limited specefically, and the amount employed at the desalting step is preferably 0.1–10 times, preferably 0.2–5 times (by weight), of the protective colloid (galatin, preferably) contained after the deselting.

The gelatin coagulant coagulates the silver halide grains together with the protective colloid, however, the silver halide emulsion can be floculated by adjusting the pH after the addition of gelatin coagulant. For the floculation, the pH values are set at below 5.5, preferably 4.8–2. Acids for adjusting the pH are not limited, and organic acids like acetic acid, citric acid and salcylic acid or inorganic acids like hydrochloic acid, nitric acid, sulfuric acid and phosphoric acid are preferably employed. In combination with the gelatin coagulant, such heavy metal ions like magnesium ion, cadmium ion, lead ion, and zirconium ion may be incorporated.

The removal of dissolved matters, (desalting) may be conducted ones or several times, and the gelatin coagulant may be added at each desalting or once at the first desalting.

For the preparation of silver halide photographic emulsion, gelatin is usually employed as the binder or protective collid, and other materials including gelatin derivatives; graftpolymers of gelatin; proteins like albumin, casein; cellulose derivatives like hydroxyethylcellulose, carboxymethyl cellulose, suger derivatives like agar, sodium alginate, starch derivatives; various synthetic hydrophillic materials including homoplymers or copolymers of polyvinyl alcohol, poly-N-vinyl pyrrolidone, polyacrylic acid, polyacrylic amide, polyvinyl imidazol and polyvinyl pyrazole.

The silver halide emulsion to be used in the present invention may be stabilized or rendered resistant against fogging by treatment with mercapto compounds (e.g. 1-phenyl-5-tetrazole and 2-mercaptobenzothiazole). benzotriazoles (e.g. 5-bromobenzotriazole and 5-methylbenzotriazole). benzimidazoles (e.g. 6-nitrobenzimidazole) and indazoles (e.g. 5-nitroindazole).

For the purpose of providing higher sensitivity, better contrast or accelerated development, the compounds described under XXI, B-D in Research Disclosure No. 17463 may be added to the light-sensitive silver halide emulsion layer and or an adjacent layer.

Addenda such as spectral sensitizers, plasticizers, antistats, surfactants and hardeners may also be added to the silver halide emulsion for use in the present invention. When the compound represented by the general formula (I) or (II) is to be added to a hydrophilic colloidal layer, gelatin is preferably used as a binder in said colloidal layer but other hydrophilic colloids than gelatin may also be used. Hydrophilic binders are preferably coated on both sides of the support in a respective amount of no more than 10 $g/m^2$.

Examples of the support that can be used in the practice of the present invention include baryta paper, polyethylene-coated paper, synthetic polypropylene paper, glass sheet; cellulose acetate film, cellulose nitrate film, and films of polyesters such as polyethylene terephthalate. A suitable support may be selected depending upon a specific use of silver halide photographic materials.

The following developing agents may be used to develop silver halide photographic materials in accordance with the present invention: $HO-(CH=CH-)_n-OH$ type developing agents, representative examples of which are hydroquinone, catechol and pyrogallol; $HO-(CH=CH)_n-NH_2$ type developing agents, representative examples of which are ortho- and paraaminophenols and aminopyrazolones such as N-methyl-p-aminophenol, N-$\beta$-hydroxyethyl-p-aminophenol, p-hydroxyphenylaminoacetic acid and 2-aminonaphthol; heterocyclic developing agents exemplified by 3-pyrazolidones such as 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4-methyl-4-hydroxymethyl-3-pyrazolidone.

Other developing agents that ca be used effectively in the present invention are described in T. H. James, "The Theory of the Photographic Process", Forth Edition pp. 291–334, Macmillan Publishing Co., Inc., 1977, and Journal of the American Chemical Society, Vol. 73, p. 3,100,1951.

The developing agents described above may be used either on their own or as admixtures. Preferably, they are used as admixtures.

The developing solutions to be used in developing photographic materials in accordance with the present invention may contain sulfites (e.g. sodium sulfite and potassium sulfite) as preservatives without compromising the advantages of the present invention. Hydroxylamine or hydrazide compounds may also be used as preservatives. In order to achieve pH adjustment and buffering action, caustic alkalis, alkali carbonates or amines may be used as in the case of common black-and-white developing solutions.

Various other additives may be incorporated in developing solutions for use in the present invention and they include: inorganic development restrainers such as potassium bromide; organic development restrainers such as 5-methylbenzotriazole, 5-methylbenzimidazole, 5-nitroindazole, adenine, guanine and 1-phenyl-5-mercaptotetrazole; metal ion sequestering agents such as ethylenediaminetetraacetic acid; development accelerators such as methanol, ethanol, benzyl alcohol and polyalkylene oxides; surfactants such as sodium alkylarylsulfonates, natural saponin, saccharides and alkyl esters of these compounds; hardeners such as glutaraldehyde, formaldehyde and glyoxal; and ionic strength adjusting agents such as sodium sulfate.

Developing solutions for use in the present invention may also contain organic solvents such as alkanolamines (e.g. diethanolamine and triethanolamine) and glycols (e.g. dlethylene glycol and triethylene glycol). Alkylaminoalcohols such as diethylamino-1,2-propanediol and butylaminopropanol may be used with particular preference.

The following examples are provided for the purpose of further illustrating the present invention but are in to way to be taken as limiting.

EXAMPLE 1

Preparation of silver halide emulsion A

A silver iodobromide emulsion (2 mol % AgI per mole of Ag) was prepared by double-jet precipitation, with $K_2IrCl_6$ being added in an amount of $8\times10^{-7}$ moles per mole of Ag. At 95% completion of grain formation, 6.5 cc of a 1% aqueous solution of potassium iodide was added per mole of Ag. The resulting emulsion was composed of cubic grains having an average size of 0.2 μm. Thereafter, a modified gelatin (G-8 listed as an exemplary compound in Japanese Patent Application No. 180787/1989) was added to the emulsion, which was washed with water and desalted by the same method as described in Japanese Patent Application No. 180787/1989. The desalted emulsion had a pAg of 8.0 at 40° C.

In a subsequent re-dispersing step, a mixture of the following compounds (A), (B) and (C) was added:

[A] + [B] + [C]

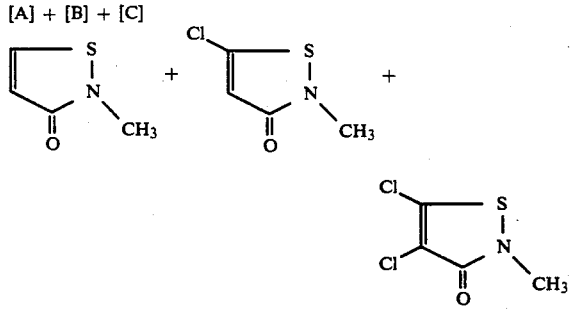

Preparation of silver halide photographic materials

A polyethylene terephthalate film 100 μm thick was coated with a subbing layer (see Example 1 in Unexamined Published Japanese Patent Application No. 19941/1984) 0.1 μm thick on both sides. A silver halide emulsion layer to the following recipe (1) was coated on one subbing layer to give a gelatin deposit of 2.0 g/m² and a silver deposit of 3.2 g/m². A protective layer to the following recipe (2) was coated on the emulsion layer to give a gelatin deposit of 1.0 g/m². A backing layer to the following recipe (3) was coated on the other subbing layer to give a gelatin deposit of 2.4 g/m² A protective layer to the following recipe (4) was further coated on the backing layer to give a gelatin deposit of 1 g/m². In this way, sample Nos. 1-10 were prepared.

| Recipe (1) of silver halide emulsion layer | |
|---|---|
| Gelatin | 2.0 g/m² |
| AgIBr emulsion A (silver deposit) | 3.2 g/m² |
| Antifoggant: adenine | 25 mg/m² |
| Stabilizer: 4-methyl-6-hydroxy-1,3,3a,7-tetrazaindene | 30 mg/m² |
| Surfactants: saponin | 0.1 g/m² |
| S-1 | 8 mg/m² |

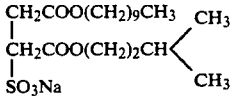

| | |
|---|---|
| Polyethylene glycol (mol. wt. 4,000) | 0.1 g/m² |
| Latex polymer: | 1 g/m² |

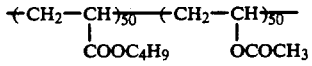

| | |
|---|---|
| Compound of the present invention or comparative compound | See Table 1 |
| Spectral sensitizer: | 8 mg/m² |

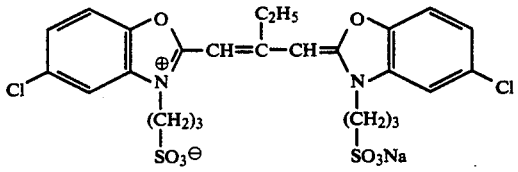

| | |
|---|---|
| Hardener H-1 | 60 mg/m² |

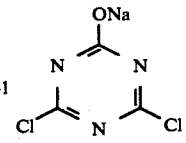

-continued

| | |
|---|---|
| Recipe (2) of emulsion protective layer | |
| Gelatin | 0.9 g/m$^2$ |
| Matting agent: silica with average particle size of 3.5 μm | 3 mg/m$^2$ |
| Surfactant: S-2 | 10 mg/m$^2$ |
| $CH_2COOCH_2(C_2H_5)C_4H_9$<br>\|<br>$CHCOOCH_2CH(C_2H_5)C_4H_9$<br>\|<br>$SO_3Na$ | |
| Hardener: formaldehyde | 30 mg/m$^2$ |
| Recipe (3) of backing layer | |
| (a) 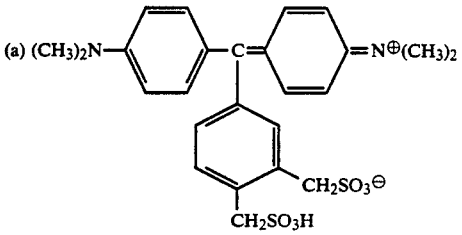 | 40 mg/m$^2$ |
| (b) 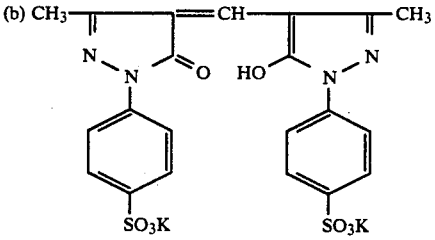 | 30 mg/m$^2$ |
| (c) 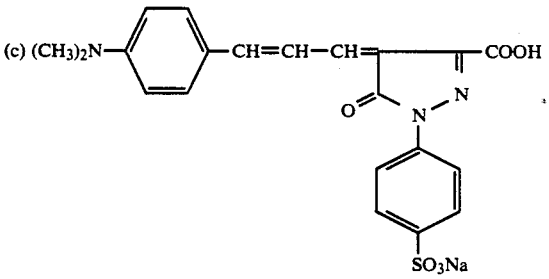 | 30 mg/m$^2$ |
| Gelatin | 2.7 g/m$^2$ |
| Surfactant: saponin | 0.1 g/m$^2$ |
| S-1 | 6 mg/m$^2$ |
| Recipe (4) of backing protective layer | |
| Gelatin | 1 g/m$^2$ |
| Matting agent: polymethyl methacrylate with average particle size of 3.0–5.0 μm | 50 mg/m$^2$ |
| Surfactant: S-2 | 10 mg/m$^2$ |
| Hardener: glyoxal | 25 mg/m$^2$ |
| H-1 | 35 mg/m$^2$ |

The samples thus prepared were placed in contact with a step wedge and exposed to light from a tungsten lamp (3200 K) for 5 sec. Thereafter, the samples were processed with a rapid automatic processor according to the scheme described below using a developing solution and a fixing solution having the recipe shown below.

| Recipe of developing solution | |
|---|---|
| Ethylenediaminetetraacetic acid sodium salt | 1 g |
| Sodium sulfite | 60 g |
| Trisodium phosphate ($12H_2O$) | 75 g |
| Hydroquinone | 22.5 g |

-continued

| | |
|---|---|
| N,N-Diethylethanolamine | 15 g |
| Sodium bromide | 3 g |
| 5-Methylbenzotriazole | 0.25 g |
| 1-Phenyl-5-mercaptotetrazole | 0.08 g |
| Methol | 0.25 g |
| Water to make | |
| pH adjusted to 11.7 with sodium hydroxide | |
| Recipe of the fixing solution | |
| Composition A: | |
| Ammonium thiosulfate (72.5% w/v aq. sol.) | 240 ml |
| Sodium sulfite | 17 g |
| Sodium acetate ($3H_2O$) | 6.5 g |
| Boric acid | 6 g |
| Sodium citrate ($2H_2O$) | 2 g |
| Composition B: | |

-continued

| | |
|---|---|
| Pure water (ion-exchanged water) | 17 ml |
| Sulfuric acid (50% w/w aq. sol.) | 4.7 g |
| Aluminum sulfate (aq. sol. with 8.1% w/w of $Al_2O_3$) | 26.5 g |

Just prior to use, compositions A and B were dissolved, in the order written, into 500 ml of water and worked up to 1,000 ml. The pH of the resulting fixing solution was adjusted to 4.8 with acetic acid.

| Step | Processing scheme Temperature, °C. | Time, sec |
|---|---|---|
| Development | 40 | 15 |
| Fixing | 35 | 15 |
| Washing | 30 | 10 |
| Drying | 50 | 10 |

The processed samples were measured for density with a Konica digital densitometer PDP-65 and the results are shown in Table 1 in terms of relative sensitivity, with the value for sample No. 1 at a density of 3.0 being taken as 100. Gamma values are also shown in Table 1 ($\gamma$=the tangent of the angle the straight line connecting densities of 0.3 and 3.0 forms with the horizontal axis of the characteristic curve). The samples were also evaluated for "black peppers". The unexposed areas were examined with a magnifying glass (×100) and the formation of black peppers was rated by the following critera: 5, none; 4, one or two black peppers in one field of vision; 3, few black peppers but low image quality; 2, extensive.

The overall results are shown in Table 1.

TABLE 1

| Sample No. | Hydrazine Comp. No. | Hydrazine Amount (mg/m²) | Compound (I), (II) No. | Compound (I), (II) Amount (mg/m²) | Relative sensitivity | Gamma | Black peppers | Remarks |
|---|---|---|---|---|---|---|---|---|
| 1 | V-3 | 15 | — | — | 100 | 9.5 | 3 | Comparison |
| 2 | III-10 | 20 | — | — | 120 | 10.2 | 3 | " |
| 3 | V-39 | 20 | — | — | 120 | 10.4 | 3 | " |
| 4 | V-3 | 15 | 4 | 50 | 98 | 9.3 | 5 | Invention |
| 5 | V-3 | 15 | 5 | 50 | 100 | 9.5 | 5 | " |
| 6 | III-10 | 20 | 5 | 50 | 118 | 10.0 | 5 | " |
| 7 | V-39 | 20 | 4 | 50 | 118 | 10.1 | 5 | " |
| 8 | V-39 | 20 | 5 | 50 | 120 | 10.2 | 5 | " |
| 9 | V-39 | 20 | 10 | 50 | 120 | 10.1 | 5 | " |
| 10 | V-39 | 20 | 19 | 50 | 118 | 10.1 | 5 | " |

EXAMPLE 2

Ten additional samples were prepared by repeating the procedure of Example 1 except that the silver halide emulsion was replaced by emulsion B shown below and that the samples were processed with a developing solution having the recipe also shown below. The results of evaluation are shown in Table 2.

Preparation of silver halide emulsion B

A silver iodobromide emulsion (0.5 mol % AgI per mole of Ag) was prepared by double-jet precipitation, with $K_2IrCl_6$ being added in an amount of $6\times10^{-7}$ moles per mole of Ag. The resulting emulsion was composed of cubic grains having an average size of 0.20 μm. This emulsion was washed with water and desalted in the usual manner. Thereafter, the desalted emulsion was subjected to sulfur sensitization at 62° C. for 90 min and the pAg at 40° C. was adjusted to 7.90 with an aqueous solution of potassium iodide.

| Recipe of developing solution | |
|---|---|
| Hydroquinone | 22.5 g |
| Methol | 0.25 g |
| Ethylenediaminetetraacetic acid | 1.0 g |
| Sodium sulfite | 75.0 g |
| Sodium hydroxide | 7.9 g |
| Trisodium phosphate ($12H_2O$) | 75.0 g |
| 5-Methylbenzotriazole | 0.25 g |
| N,N-Diethylethanolamine | 12.5 ml |
| Water | to make 1,000 ml |
| pH | adjusted to 11.6 |

TABLE 2

| Sample No. | Hydrazine Comp. No. | Hydrazine Amount (mg/m²) | Compound (I), (II) No. | Compound (I), (II) Amount (mg/m²) | Relative sensitivity | Gamma | Black peppers | Remarks |
|---|---|---|---|---|---|---|---|---|
| 11 | V-3 | 15 | — | — | 100 | 9.4 | 3 | Comparison |
| 12 | III-10 | 20 | — | — | 120 | 10.1 | 3 | " |
| 13 | V-39 | 20 | — | — | 125 | 10.3 | 4 | " |
| 14 | V-3 | 15 | 4 | 50 | 98 | 9.2 | 5 | Invention |
| 15 | V-3 | 15 | 5 | 50 | 100 | 10.1 | 5 | " |
| 16 | III-10 | 20 | 5 | 50 | 119 | 10.0 | 5 | " |
| 17 | V-39 | 20 | 4 | 50 | 121 | 10.1 | 5 | " |
| 18 | V-39 | 20 | 5 | 50 | 125 | 10.3 | 5 | " |
| 19 | V-39 | 20 | 10 | 50 | 123 | 10.2 | 5 | " |
| 20 | V-39 | 20 | 19 | 50 | 123 | 10.1 | 5 | " |

EXAMPLE 3

Ten more samples were prepared as in Example 1 except that an iron powder (product of Wako Pure Chemical Industries, Ltd.) was added in an amount of 5 mg/m² to the silver halide emulsion to simulate the incorporation of atmospheric suspended matter or fine particles of heavy metals or oxides thereof into the emulsion during manufacture. The thus prepared samples were evaluated for the formation of black peppers. The results are shown in Table 3.

TABLE 3

| Sample No. | Hydrazine Comp. No. | Hydrazine Amount (mg/m²) | Compound (I), (II) No. | Compound (I), (II) Amount (mg/m²) | Black pepper due to iron powder | Remarks |
|---|---|---|---|---|---|---|
| 1 | V-3 | 15 | — | — | 2 | Comparison |
| 2 | III-10 | 20 | — | — | 2 | " |
| 3 | V-39 | 20 | — | — | 2 | " |
| 4 | V-3 | 15 | 4 | 50 | 5 | Invention |
| 5 | V-3 | 15 | 5 | 50 | 5 | " |
| 6 | III-10 | 20 | 5 | 50 | 5 | " |
| 7 | V-39 | 20 | 4 | 50 | 5 | " |
| 8 | V-39 | 20 | 5 | 50 | 5 | " |
| 9 | V-39 | 20 | 10 | 50 | 5 | " |
| 10 | V-39 | 20 | 19 | 50 | 5 | " |

As the data in Tables 1–3 show, the samples prepared in accordance with the present invention were greatly improved in resistance to the formation of black peppers without compromising sensitivity and contrast characteristics. Their resistance to black pepper formation was not at all deteriorated even when an iron powder was intentionally added to the emulsion.

The present invention provides a silver halide photographic material that uses a hydrazine compound and which is improved in resistance to the formation of black peppers without impairing its ability to produce a contrasty image. Further, this photographic material can be manufactured in a consistent way.

What is claimed is:

1. A silver halide photographic material that has at least one silver halide emulsion layer on a support and that contains a hydrazine derivative in said emulsion layer or an adjacent layer, wherein said emulsion layer or at least one of the other hydrophilic colloidal layers contains at least one of the compounds represented by the following general formulas (I) and (II):

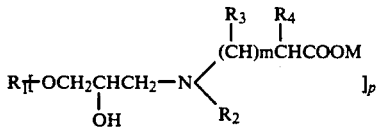

(I)

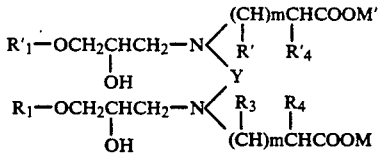

(II)

where $R_1$ and $R_1'$ are each a group selected from among a substituted or unsubstituted alkane residue, an alkene residue, a benzene residue, a cyclohexane residue and a nitrogenous heterocyclic residue; $R_2$ is a substituted or unsubstituted alkyl group; $R_3$, $R_3'$, $R_4$ and $R_4'$ are each a hydrogen atom or a substituted or unsubstituted methyl group, provided that $R_3$ and $R_4$ or $R_3'$ are not a methyl group at the same time; Y is a divalent organic residue; M and M' arc each a hydrogen atom, an alkali metal, an ammonium salt or an organic amine salt; P is a positive integer; and m is 0 or 1.

2. A silver halide photographic material according to claim 1 wherein the compound represented by the general formula (I) or (II) is contained in an amount of $5\times10^{-6}$ to $1\times10^{-2}$ mole.

3. A silver halide photographic material according to claim 1 wherein the compound represented by the general formula (I) or (II) is contained in the silver halide emulsion layer or a hydrophilic colloidal layer adjacent thereto.

4. A silver halide photographic material according to claim 1 wherein the hydrazine derivative is at least one of the compounds represented by the following general formulas (III), (IV) and (V):

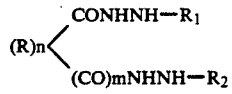

(III)

(where $R_1$ and $R_2$ are each an aryl or heterocyclic group; R is an organic bonding group; n is 0–6; m is 0 or 1: when n is 2 or more, R may be the same or different);

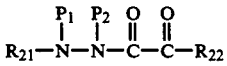

(IV)

(where $R_{21}$ is an aliphatic group, an aromatic group or a heterocyclic group; $R_{22}$ is a hydrogen atom, a substituted or unsubstituted alkoxy group, a hetero ring, an oxy group, an amino group or an aryloxy group; $P_1$ and $P_2$ are each a hydrogen atom, an acyl group or a sulfinic acid group);

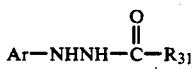

(V)

(where Ar is an aryl group containing at least one non-diffusible group or at least one group capable of promoting adsorption or silver halide; $R_{31}$ is a substituted alkyl group).

5. A silver halide photographic material according to claim 4 wherein $R_1$ and $R_2$ in the general formula (III) are each a substituted or unsubstituted phenyl group, n=m=1, and R is an alkylene group.

6. A silver halide photographic material according to claim 4 wherein the compound represented by the general formula (IV) is more specifically represented by the following general formula (IV-a)

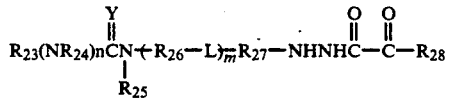

(IV-a)

where $R_{23}$ and $R_{24}$ are each a hydrogen atom, a substituted or unsubstituted alkyl group, a substituted or unsubstituted phenyl group, a naphthyl group, a cyclohexyl group, a pyridyl group, or a pyrrolidyl group; $R_{25}$ is a hydrogen atom or a substituted or unsubstituted benzyl, alkoxy or alkyl group; $R_{26}$ and $R_{27}$ are each a divalent aromatic group; Y is a sulfur or oxygen atom; L is a divalent bonding group; $R_{28}$ is —R'R" or —$OR_{29}$ (where R', R" and $R_{29}$ are each a hydrogen atom, a substituted or unsubstituted alkyl, phenyl or naphthyl group or a heterocyclic group, provided that R' and R" may combine with the nitrogen atom to form a ring; and m and n are each 0 or 1.

7. A silver halide photographic material according to claim 4 wherein the hydrazine derivative is contained in an amount of $5\times10^{-7}$ to $5\times10^{-1}$ moles per mole of silver halide.

8. A silver halide photographic material according to claim 4 wherein the hydrazine derivative is contained in an amount of $5\times10^{-6}$ to $1\times10^{-2}$ mole per mole of silver halide.

9. A silver halide photographic material according to claim 1 wherein the silver halide grains in the silver halide emulsion layer have an average grain size of $0.05\times0.5$ μm.

10. A silver halide photographic material according to claim 9 wherein said silver halide grains are silver iodobromide grains of a multilayered structure, with the core being made of silver iodobromide and the shell being made of silver bromide, and with iodine being incorporated in any layer in an amount not exceeding 5 mol %.

* * * * *